US011186943B2

(12) United States Patent
Cagliani

(10) Patent No.: US 11,186,943 B2
(45) Date of Patent: Nov. 30, 2021

(54) FILTER CONFIGURED FOR BEING USED IN A MACHINE FOR DRYING LAUNDRY AND MACHINE FOR DRYING LAUNDRY EQUIPPED WITH SUCH A FILTER

(71) Applicant: WHIRLPOOL CORPORATION, Benton Harbor, MI (US)

(72) Inventor: Marco Cagliani, Comerio (IT)

(73) Assignee: Whirlpool Corporation, Benton Harbor, MI (US)

( * ) Notice: Subject to any disclaimer, the term of this patent is extended or adjusted under 35 U.S.C. 154(b) by 205 days.

(21) Appl. No.: 16/135,443

(22) Filed: Sep. 19, 2018

(65) Prior Publication Data

US 2019/0106833 A1 Apr. 11, 2019

(30) Foreign Application Priority Data

Oct. 9, 2017 (EP) ..... 171955651

(51) Int. Cl.

| | |
|---|---|
| ***D06F 58/22*** | (2006.01) |
| *D06F 39/10* | (2006.01) |
| *D06F 58/20* | (2006.01) |
| *D06F 25/00* | (2006.01) |

(52) U.S. Cl.

CPC ..... *D06F 58/22* (2013.01); *D06F 25/00* (2013.01); *D06F 39/10* (2013.01); *D06F 58/206* (2013.01)

(58) Field of Classification Search

CPC ..... D06F 58/22; D06F 58/30; D06F 25/00; D06F 39/10; D06F 58/24; D06F 58/04; D06F 58/206; D06F 58/45; D06F 2105/34; F26B 21/003; B01D 46/00; B01D 46/0002; B01D 46/0004; B01D 46/0006; B01D 46/0023; B01D 2267/40; B01D 2267/70

USPC ..... 34/82, 480; 55/434, 482

See application file for complete search history.

(56) References Cited

U.S. PATENT DOCUMENTS

| | | | |
|---|---|---|---|
| 2,023,534 | A | 12/1935 | Mahoney et al. |
| 2,550,118 | A | 4/1951 | Kauffman |
| 2,957,330 | A | 10/1960 | Cline |
| 3,089,327 | A | 5/1963 | Stilwell, Jr. et al. |

(Continued)

FOREIGN PATENT DOCUMENTS

| | | | |
|---|---|---|---|
| CH | 462085 | A | 9/1968 |
| CH | 520307 | A | 3/1972 |

(Continued)

OTHER PUBLICATIONS

European Search Report for EP17195564.4, dated Jan. 11, 2018.
European Search Report for EP17195565.1, dated Jan. 8, 2018.

*Primary Examiner* — Jessica Yuen
(74) *Attorney, Agent, or Firm* — McGarry Bair PC

(57) ABSTRACT

A filter assembly configured for being used in combination with a machine for drying laundry is disclosed. The filter assembly comprises a frame, a duct defined in the frame configured for being passed through by an airflow, an inlet section configured for allowing the airflow to have access to the duct and an outlet section configured for allowing the airflow to leave the duct. The filter assembly comprises a filter configured for intercepting the airflow and for separating from the airflow possible solid particles carried by the airflow, the filter acting between the inlet section and the outlet section and storage configured for storing the solid particles separated from the airflow.

10 Claims, 18 Drawing Sheets

(56) References Cited

U.S. PATENT DOCUMENTS

| | | | | |
|---|---|---|---|---|
| 3,190,011 | A | 6/1965 | Shields | |
| 4,603,489 | A | 8/1986 | Goldberg | |
| 4,621,438 | A | 11/1986 | Lanciaux | |
| 4,653,200 | A | 3/1987 | Werner | |
| 5,361,511 | A | 11/1994 | Brown | |
| 6,981,336 | B2 | 1/2006 | Nagae et al. | |
| 7,020,986 | B1 | 4/2006 | Nakai et al. | |
| 7,024,795 | B2 | 4/2006 | Tadano et al. | |
| 7,497,030 | B2 | 3/2009 | Belgard | |
| 7,637,127 | B2 | 12/2009 | Mills et al. | |
| 7,854,325 | B2 * | 12/2010 | Bentele | B65D 5/38 206/531 |
| 7,886,458 | B2 | 2/2011 | Blair | |
| 8,266,813 | B2 | 9/2012 | Grunert et al. | |
| 8,353,114 | B2 | 1/2013 | Beers et al. | |
| 8,387,268 | B2 | 3/2013 | Ahn et al. | |
| 8,393,172 | B2 | 3/2013 | Sato et al. | |
| 8,528,227 | B2 | 9/2013 | Beers et al. | |
| 8,572,865 | B2 | 11/2013 | Beers et al. | |
| 8,601,717 | B2 | 12/2013 | Beers et al. | |
| 8,833,095 | B2 | 9/2014 | Beers et al. | |
| 8,973,282 | B2 | 3/2015 | Mackay | |
| 9,139,949 | B2 * | 9/2015 | Goldberg | D06F 58/22 |
| 9,187,860 | B2 | 11/2015 | Masters | |
| 9,228,293 | B2 | 1/2016 | Yeom | |
| 9,371,609 | B2 | 6/2016 | Anderson et al. | |
| 9,488,412 | B2 | 11/2016 | Yu et al. | |
| 2003/0233854 | A1 | 12/2003 | Matsuda et al. | |
| 2005/0198851 | A1 | 9/2005 | Tomochika et al. | |
| 2010/0107703 | A1 | 5/2010 | Hisano et al. | |
| 2013/0008049 | A1 | 1/2013 | Patil | |
| 2015/0176192 | A1 | 6/2015 | Bison et al. | |
| 2015/0247278 | A1 * | 9/2015 | Gregory | D06F 58/22 34/480 |
| 2015/0322610 | A1 | 11/2015 | Garlatti et al. | |
| 2015/0345866 | A1 | 12/2015 | Yu et al. | |

FOREIGN PATENT DOCUMENTS

| | | | |
|---|---|---|---|
| CH | 699018 | B9 | 3/2010 |
| CN | 2808981 | Y | 8/2006 |
| CN | 102206916 | A | 10/2011 |
| CN | 102286872 | A | 12/2011 |
| CN | 102560987 | A | 7/2012 |
| CN | 103306113 | A | 9/2013 |
| CN | 103510371 | A | 1/2014 |
| CN | 103882662 | A | 6/2014 |
| CN | 104695192 | A | 6/2015 |
| CN | 106337269 | A | 1/2017 |
| CN | 105483970 | B | 10/2018 |
| DE | 1827021 | U | 2/1961 |
| DE | 3543722 | A1 | 10/1987 |
| DE | 4216106 | A1 | 11/1993 |
| DE | 4304226 | A1 | 8/1994 |
| DE | 19642164 | A1 | 4/1998 |
| DE | 19638865 | C2 | 1/2003 |
| DE | 102006018469 | A1 | 10/2007 |
| DE | 102010028441 | A1 | 11/2011 |
| DE | 102005014842 | B8 | 3/2012 |
| DE | 102012105670 | A1 | 1/2014 |
| EP | 0254018 | A1 | 1/1988 |
| EP | 0345510 | B1 | 5/1992 |
| EP | 0552843 | B1 | 4/1996 |
| EP | 1156149 | A2 | 11/2001 |
| EP | 1197592 | A2 | 4/2002 |
| EP | 1277872 | A2 | 1/2003 |
| EP | 1055767 | B1 | 8/2003 |
| EP | 1209277 | B1 | 12/2003 |
| EP | 1022373 | B1 | 3/2004 |
| EP | 1405946 | A2 | 4/2004 |
| EP | 1103647 | B1 | 6/2004 |
| EP | 1098028 | B1 | 7/2004 |
| EP | 1441060 | A1 | 7/2004 |
| EP | 1108812 | B1 | 8/2004 |
| EP | 1584734 | A2 | 10/2005 |
| EP | 1983094 | A1 | 10/2005 |
| EP | 1634984 | A1 | 3/2006 |
| EP | 1645675 | A1 | 4/2006 |
| EP | 1657341 | A2 | 5/2006 |
| EP | 2025802 | A2 | 2/2009 |
| EP | 2058427 | A1 | 5/2009 |
| EP | 2071069 | A1 | 6/2009 |
| EP | 1854916 | B1 | 7/2009 |
| EP | 1349480 | B1 | 8/2009 |
| EP | 1411163 | B1 | 9/2009 |
| EP | 1541745 | B1 | 9/2010 |
| EP | 2253757 | A1 | 11/2010 |
| EP | 2199453 | B1 | 7/2011 |
| EP | 2212463 | B1 | 7/2011 |
| EP | 2227582 | B1 | 8/2011 |
| EP | 2271801 | B1 | 12/2011 |
| EP | 2159317 | B1 | 1/2012 |
| EP | 2194183 | B1 | 1/2012 |
| EP | 2415928 | A2 | 2/2012 |
| EP | 2270275 | B1 | 3/2012 |
| EP | 2436818 | A1 | 4/2012 |
| EP | 2443983 | A2 | 4/2012 |
| EP | 2458071 | A1 | 5/2012 |
| EP | 2471994 | A1 | 7/2012 |
| EP | 2471998 | A1 | 7/2012 |
| EP | 2419559 | B1 | 11/2012 |
| EP | 2422010 | B1 | 11/2012 |
| EP | 2182104 | B1 | 1/2013 |
| EP | 2034084 | B1 | 2/2013 |
| EP | 2559804 | A1 | 2/2013 |
| EP | 2570546 | A1 | 3/2013 |
| EP | 2589698 | A1 | 5/2013 |
| EP | 2479337 | B1 | 8/2013 |
| EP | 2270274 | B1 | 9/2013 |
| EP | 2436831 | B1 | 9/2013 |
| EP | 2281934 | B1 | 4/2014 |
| EP | 2339063 | B1 | 4/2014 |
| EP | 2719820 | A2 | 4/2014 |
| EP | 2573252 | B1 | 5/2014 |
| EP | 2664706 | B1 | 5/2014 |
| EP | 2455537 | B1 | 7/2014 |
| EP | 2628838 | B1 | 9/2014 |
| EP | 2813615 | A2 | 12/2014 |
| EP | 2333148 | B1 | 1/2015 |
| EP | 2612964 | B1 | 3/2015 |
| EP | 2843099 | A1 | 3/2015 |
| EP | 2843103 | A1 | 3/2015 |
| EP | 2843111 | A1 | 3/2015 |
| EP | 2843118 | A1 | 3/2015 |
| EP | 2843120 | A2 | 3/2015 |
| EP | 2843123 | A1 | 3/2015 |
| EP | 2843124 | A1 | 3/2015 |
| EP | 2843125 | A1 | 3/2015 |
| EP | 2871280 | A1 | 5/2015 |
| EP | 2270276 | B1 | 6/2015 |
| EP | 2489774 | B1 | 6/2015 |
| EP | 2513367 | B1 | 6/2015 |
| EP | 2702199 | B1 | 6/2015 |
| EP | 2930453 | A1 | 10/2015 |
| EP | 2799612 | B1 | 12/2015 |
| EP | 2037034 | B1 | 1/2016 |
| EP | 2612963 | B1 | 3/2016 |
| EP | 2711449 | B1 | 3/2016 |
| EP | 3000928 | A1 | 3/2016 |
| EP | 3000929 | A1 | 3/2016 |
| EP | 2735639 | B1 | 4/2016 |
| EP | 2799613 | B1 | 4/2016 |
| EP | 2660381 | B1 | 5/2016 |
| EP | 3023531 | A1 | 5/2016 |
| EP | 2415927 | B1 | 7/2016 |
| EP | 2660382 | B1 | 8/2016 |
| EP | 2660383 | B1 | 8/2016 |
| EP | 2029804 | B1 | 10/2016 |
| EP | 2199452 | B1 | 10/2016 |
| EP | 2385163 | B1 | 10/2016 |
| EP | 2719810 | B1 | 10/2016 |
| EP | 2309053 | B1 | 11/2016 |
| EP | 2436832 | B1 | 11/2016 |

(56) References Cited

FOREIGN PATENT DOCUMENTS

| | | | |
|---|---|---|---|
| EP | 2436830 | B1 | 12/2016 |
| EP | 1866475 | B1 | 1/2017 |
| EP | 3115500 | A1 | 1/2017 |
| EP | 3118365 | A1 | 1/2017 |
| EP | 2339062 | B1 | 2/2017 |
| EP | 2373840 | B1 | 2/2017 |
| EP | 2925924 | B1 | 2/2017 |
| EP | 2586904 | B1 | 3/2017 |
| EP | 2848731 | B1 | 3/2017 |
| EP | 2990522 | B1 | 3/2017 |
| EP | 2711450 | B1 | 4/2017 |
| EP | 3015590 | B1 | 4/2017 |
| EP | 2403985 | B1 | 5/2017 |
| EP | 2848730 | B1 | 5/2017 |
| EP | 2351883 | B1 | 6/2017 |
| EP | 2612966 | B1 | 8/2017 |
| EP | 2843100 | B1 | 8/2017 |
| EP | 2843119 | B1 | 10/2017 |
| EP | 3026168 | B1 | 1/2018 |
| EP | 2612965 | B1 | 4/2018 |
| EP | 2110473 | B1 | 6/2018 |
| EP | 2957671 | B1 | 8/2018 |
| EP | 3109358 | B1 | 8/2018 |
| FR | 2919624 | B1 | 12/2012 |
| GB | 715689 | A | 9/1954 |
| GB | 1205694 | A | 9/1970 |
| GB | 1466103 | A | 3/1977 |
| GB | 1472686 | A | 5/1977 |
| GB | 1573273 | A | 8/1980 |
| GB | 1581468 | A | 12/1980 |
| GB | 2052707 | A | 1/1981 |
| GB | 2075559 | A | 11/1981 |
| GB | 2172977 | A | 10/1986 |
| GB | 2248920 | A | 4/1992 |
| GB | 2262595 | A | 6/1993 |
| GB | 2287476 | A | 9/1995 |
| GB | 2291891 | A | 2/1996 |
| GB | 2318408 | A | 4/1998 |
| GB | 2382642 | A | 6/2003 |
| GB | 2437691 | A | 10/2007 |
| GB | 2507193 | A | 4/2014 |
| GB | 2507194 | A | 4/2014 |
| GB | 2507195 | A | 4/2014 |
| IT | 1068213 | A | 3/1985 |
| IT | 1295469 | B1 | 5/1999 |
| JP | H0662989 | U | 9/1994 |
| JP | 2000093697 | A | 4/2000 |
| JP | 3424655 | B2 | 7/2003 |
| JP | 2004135715 | A | 5/2004 |
| JP | 3868471 | B2 | 1/2007 |
| JP | 3920302 | B1 | 5/2007 |
| JP | 2007135728 | A | 6/2007 |
| JP | 2007151799 | A | 6/2007 |
| JP | 2008055077 | A2 | 3/2008 |
| JP | 4263132 | B2 | 5/2009 |
| JP | 2009219789 | A2 | 10/2009 |
| JP | 4607774 | B2 | 1/2011 |
| JP | 4612563 | B2 | 1/2011 |
| JP | 4764861 | B2 | 9/2011 |
| JP | 2012075506 | A | 4/2012 |
| JP | 4965545 | B2 | 7/2012 |
| JP | 5440467 | B2 | 3/2014 |
| JP | 5556578 | B2 | 7/2014 |
| JP | 2014140440 | A | 8/2014 |
| JP | 5603806 | B2 | 10/2014 |
| JP | 5649039 | B2 | 1/2015 |
| JP | 5649483 | B2 | 1/2015 |
| JP | 5909428 | B2 | 4/2016 |
| KR | 100823325 | B1 | 4/2008 |
| WO | 2005001357 | A1 | 1/2005 |
| WO | 2005032322 | A2 | 4/2005 |
| WO | 2005088003 | A1 | 9/2005 |
| WO | 2006054431 | A1 | 5/2006 |
| WO | 2006097901 | A2 | 9/2006 |
| WO | 2007058009 | A1 | 5/2007 |
| WO | 2007058145 | A1 | 5/2007 |
| WO | 2007060796 | A1 | 5/2007 |
| WO | 2007073052 | A1 | 6/2007 |
| WO | 2008110451 | A1 | 9/2008 |
| WO | 2008146488 | A1 | 12/2008 |
| WO | 2009059874 | A1 | 5/2009 |
| WO | 2009148251 | A2 | 12/2009 |
| WO | 2010137910 | A2 | 12/2010 |
| WO | 2011061068 | A1 | 5/2011 |
| WO | 2012022803 | A1 | 2/2012 |
| WO | 2012023824 | A2 | 2/2012 |
| WO | 2012028576 | A1 | 3/2012 |
| WO | 2012044039 | A2 | 4/2012 |
| WO | 2012093059 | A1 | 7/2012 |
| WO | 2013007506 | A1 | 1/2013 |
| WO | 2013102636 | A2 | 7/2013 |
| WO | 2013102638 | A1 | 7/2013 |
| WO | 2013111589 | A1 | 8/2013 |
| WO | 2014032871 | A1 | 3/2014 |
| WO | 2014038112 | A1 | 3/2014 |
| WO | 2014044531 | A1 | 3/2014 |
| WO | 2014091332 | A1 | 6/2014 |
| WO | 2014115976 | A1 | 7/2014 |
| WO | 2014127799 | A1 | 8/2014 |
| WO | 2015003741 | A1 | 1/2015 |
| WO | 2015003742 | A1 | 1/2015 |
| WO | 2015016571 | A1 | 2/2015 |
| WO | 2015068934 | A1 | 5/2015 |
| WO | 2015155009 | A1 | 10/2015 |
| WO | 2016108101 | A1 | 7/2016 |
| WO | 2016108102 | A1 | 7/2016 |
| WO | 2016108795 | A1 | 7/2016 |
| WO | 2016128849 | A1 | 8/2016 |
| WO | 2016174555 | A1 | 11/2016 |
| WO | 2016192979 | A1 | 12/2016 |

* cited by examiner

FIG.17
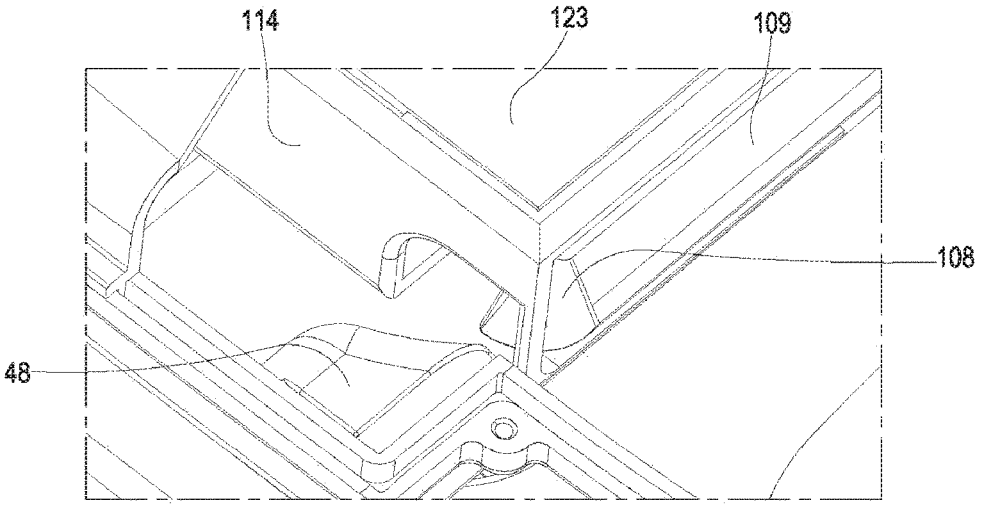
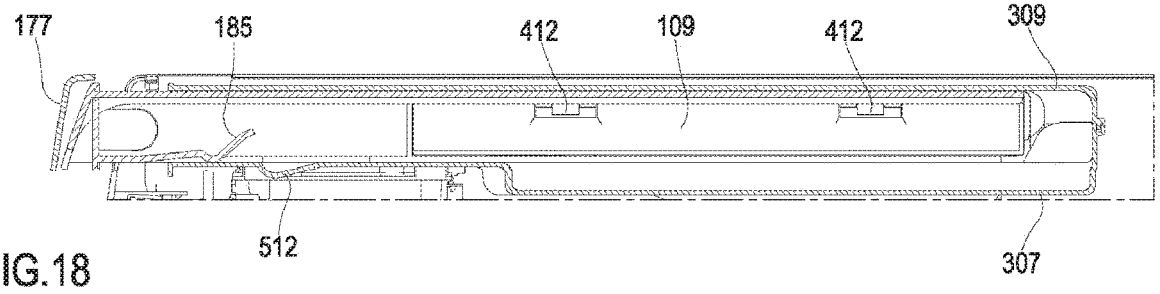
FIG.18

FIG.19
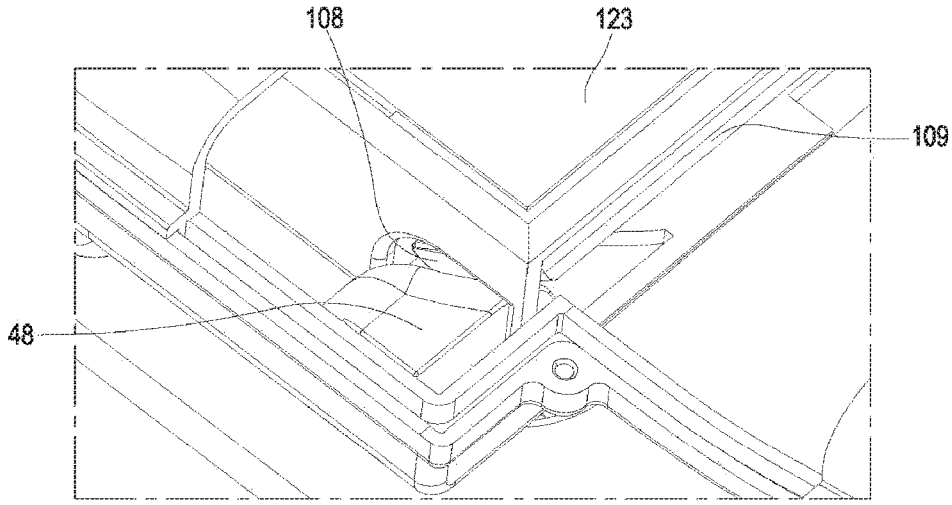
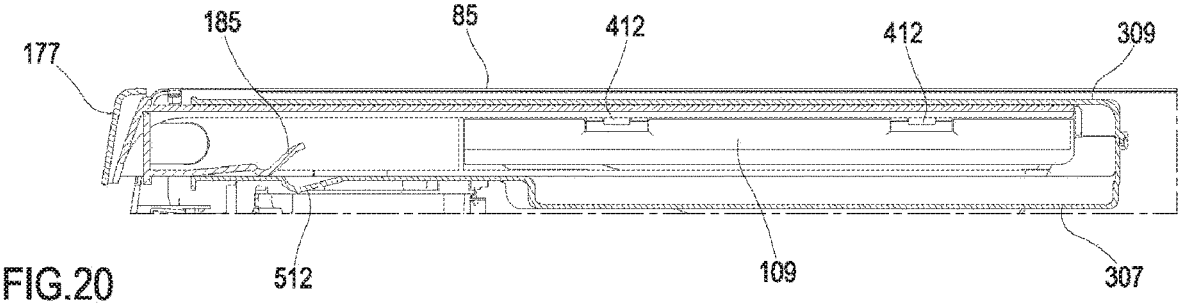
FIG.20

FILTER CONFIGURED FOR BEING USED IN A MACHINE FOR DRYING LAUNDRY AND MACHINE FOR DRYING LAUNDRY EQUIPPED WITH SUCH A FILTER

CROSS REFERENCE TO RELATED APPLICATIONS

This application claims priority to European Patent Application No. 17195565.1 filed Oct. 9, 2017, which is hereby incorporated by reference in its entirety.

FIELD OF THE INVENTION

The present disclosure relates to a filter configured for being used in a machine for drying laundry. In particular, the filter acts as a separator of the fluff from the drying airflow carrying the fluff. The machine equipped with the filter is preferably a washer-dryer that includes a heat pump system, configured for condensing the moisture extracted from the laundry and for heating up the drying airflow as well.

BACKGROUND OF THE INVENTION

During the drying of clothes in a clothes dryer, the drying airflow, coming in contact with the clothes in the drum, induces an undesired expulsion of fluff from the clothes. The fluff withdrawn from the clothes is then carried by the drying airflow towards the drying circuit. The fluff has then to be separated from the drying airflow in order to avoid that it could damage peculiar components of the clothes dryer, e.g. the fan and/or the heater. Therefore filter are installed at the beginning of the drying airflow, in order to separate the fluff from the drying airflow. The fluff collected in the filter obstructs the drying circuit, so that a periodic cleaning of the filter is necessary in order to guarantee a proper operation of the drying circuit.

Several technical solutions of clothes dryer filters are known in the state of the art. Some technical solutions are manual and require a periodic intervention of the user that has to remove the fluff collected in the filter. Some technical solutions are instead automatic and presuppose that the machine is fully capable of removing the collected fluff from the filter and then of disposing the fluff outside the clothes dryer.

SUMMARY OF THE INVENTION

A first aspect of the disclosure relates to a filter assembly (configured for being used in combination with a machine for drying laundry, in particular a washer-dryer, comprising:

a frame;

a duct defined in the frame configured for being passed through by an airflow, in particular by a drying airflow;

an inlet section configured for allowing the airflow to have access to the duct;

an outlet section configured for allowing the airflow to leave the duct;

a filter configured for intercepting the airflow and for separating from the airflow possible solid particles, in particular fluff, carried by the airflow, the filter acting between the inlet section and the outlet section and storage configured for storing the solid particles separated from the airflow, characterised by further comprising a closure associated to the inlet section, the closure being selectively switchable between a first configuration and a second configuration, the closure being in particular rotatable or slidable with respect to the frame, in the first configuration of the closure the inlet section is closed so that the access of the airflow to the duct is substantially prevented, in the second configuration of the closure the inlet section is open so that the access of the airflow to the duct is allowed.

A second aspect of the disclosure, dependent on the first aspect, relates to a filter assembly, further comprising an actuator configured for switching automatically the configuration of the closure from the first configuration to the second configuration and/or from the second configuration to the first configuration.

A third aspect of the disclosure, dependent on the first aspect or on the second aspect, relates to a filter assembly, wherein the closure comprises a rotatable flap hinged to the frame, the inlet section being in particular defined in a lateral wall of the frame.

A fourth aspect of the disclosure, dependent on the second aspect or on the third aspect, relates to a filter assembly, wherein the actuator comprises a portion of the rotatable flap, in particular an end portion of the rotatable flap, said portion of the rotatable flap having a rounded profile in order to act as a member of a cam coupling.

A fifth aspect of the disclosure, dependent on the fourth aspect, relates to a filter assembly, wherein said portion of the rotatable flap is configured for actuating the switching of the configuration of the closure from the first configuration to the second configuration, whilst the switching of the configuration of the closure from the second configuration to the first configuration takes place under the action of the gravitational force and/or of an elastic force.

A sixth aspect of the disclosure, dependent on any of the previous aspects, relates to a filter assembly, wherein the filter comprises a first filtering mesh and a second filtering mesh, the first filtering mesh being positioned upstream of the second filtering mesh and being coarser than the second filtering mesh, and wherein the storage comprises a first storage room and a second storage room positioned upstream of the first filtering mesh and of the second filtering mesh respectively.

A seventh aspect of the disclosure, dependent on the sixth aspect, relates to a filter assembly, wherein the second filtering mesh is associated to the outlet section, the outlet section being in particular defined in a lateral wall of the frame and/or in a bottom wall of the frame.

An eighth aspect of the disclosure, dependent on any of the previous aspects, relates to a filter assembly, wherein the frame comprises a deflector configured for making said duct convergent.

A ninth aspect of the disclosure, dependent on any of the previous aspects, relates to a filter assembly, characterized by being drawer-like and by being configured for being housed in a slot of a machine for drying laundry, in particular a washer-dryer.

A tenth aspect of the disclosure, dependent on the ninth aspect, relates to a filter assembly, further comprising a stop configured for stopping the insertion of the filter assembly in the slot, wherein the stop comprises in particular an elastic tab associated to a wall of the frame, preferably to a bottom wall of the frame.

An eleventh independent aspect of the disclosure relates to a machine for drying laundry, in particular a washer-dryer, comprising a cabinet and a drying circuit, characterised by further comprising a filter assembly according to any of the previous aspects and a slot within the cabinet, the slot being in fluid communication with the drying circuit, wherein the filter assembly may assume at least a first position and a second position, in the first position the filter assembly being extracted from the slot at least partly so that the storage is accessible for cleaning and/or removal of collected fluff operations, in the second position the filter assembly being housed in the slot so that the filter can intercept the drying airflow and can separate from the drying airflow the fluff carried by the drying airflow.

A twelfth aspect of the disclosure, dependent on the eleventh aspect, relates to a machine for drying laundry, in particular a washer-dryer, further comprising a respective actuator configured for interacting with the actuator of the filter assembly in order to switch automatically the configuration of the closure from the first configuration to the second configuration when the position of the filter assembly changes from the first position to the second position and/or from the second configuration to the first configuration when the position of the filter assembly changes from the second position to the first position, wherein the actuator of the machine comprises in particular a bulge, the bulge having a rounded profile conjugated to the rounded profile of the end portion of the rotatable flap, in order to act as a member of a cam coupling.

A thirteenth aspect of the disclosure, dependent on the eleventh aspect or on the twelfth aspect, relates to a machine for drying laundry, in particular a washer-dryer, wherein the deflector is configured for acting as a wall of a conduit of the drying circuit when the filter assembly assumes the second position.

A fourteenth aspect of the disclosure, dependent on any of the aspects from the eleventh aspect to the thirteenth aspect, relates to a machine for drying laundry, in particular a washer-dryer, the filter assembly further comprising a handle connected to the frame, wherein the handle is substantially flush with a front panel of the machine when the filter assembly assumes the second position.

A fifteenth aspect of the disclosure, dependent on any of the aspects from the eleventh aspect to the fourteenth aspect, relates to a machine for drying laundry, in particular a washer-dryer, further comprising a drum housed in the cabinet and a heat pump system configured for exchanging heat with the drying circuit, wherein in particular the slot is positioned substantially above the drum.

A sixteenth independent aspect of the disclosure relates to a machine for drying laundry, in particular a washer-dryer, comprising:

a cabinet;

an oscillating assembly housed in the cabinet and comprising in turn a tub and a drum housed in the tub, the drum having a substantially horizontal longitudinal axis;

a drying circuit connected with the tub at its ends, a condensing segment and a heating segment being provided in the drying circuit;

a blower apt to move a drying airflow in the drying circuit, the drying airflow circulating in the drying circuit so that the condensing segment is positioned in the drying circuit upstream of the heating segment, the condensing segment being configured for reducing the moisture content in the drying airflow and the heating segment being configured for increasing the temperature of the drying airflow and a heat pump system including an evaporator, a condenser and a compressor, the evaporator being housed in the condensing segment and the condenser being housed in the heating segment, characterised in that the evaporator, the condenser and the compressor are supported by the cabinet, the evaporator and the condenser being positioned substantially above the drum, the compressor being positioned substantially below the drum, and in that the compressor is connected to the evaporator and to the condenser by flexible pipes.

A seventeenth aspect of the disclosure, dependent on the sixteenth aspect, relates to a machine for drying laundry, in particular a washer-dryer, wherein the blower is supported by the cabinet and is positioned substantially above the drum, the blower being in particular positioned upstream of the condensing segment.

An eighteenth aspect of the disclosure, dependent on the sixteen aspect or on the seventeenth aspect, relates to a machine for drying laundry, in particular a washer-dryer, further comprising an electric heater, wherein the electric heater is housed in the heating segment, the electric heater being in particular positioned downstream of the condenser.

A nineteenth aspect of the disclosure, dependent on any of the aspects from the sixteenth aspect to the eighteenth aspect, relates to a machine for drying laundry, in particular a washer-dryer, wherein the drying circuit includes at least one rigid conduit, the at least one rigid conduit being supported by the cabinet and comprising in particular a hollow body formed by at least a first semi-shell and a second semi-shell joined together.

A twentieth aspect of the disclosure, dependent on the nineteenth aspect, relates to a machine for drying laundry, in particular a washer-dryer, wherein a drain is obtained at the bottom of the at least one rigid conduit and wherein in particular the drain comprises a draining hole and an inclined portion adjacent to the draining hole, the draining hole being connected to the tub by a flexible hose.

A twenty-first aspect of the disclosure, dependent on the nineteenth aspect or on the twentieth aspect, relates to a machine for drying laundry, in particular a washer-dryer, wherein the drying circuit includes at least one flexible conduit connected to an end of the at least one rigid conduit, the at least one rigid conduit being in fluid communication with the tub by the at least one flexible conduit.

A twenty-second aspect of the disclosure, dependent on the twenty-first aspect, relates to a machine for drying laundry, in particular a washer-dryer, the cabinet having a front wall, a loading aperture communicating with the drum being defined in the front wall, the machine comprising a door apt to selectively close the loading aperture and a gasket apt to seal the interspace between the front wall and the door, wherein the at least one flexible conduit is built in a single piece with the gasket.

A twenty-third aspect of the disclosure, dependent on the twenty-first aspect or on the twenty-second aspect, relates to a machine for drying laundry, in particular a washer-dryer, wherein the drying circuit comprises:

a first flexible conduit;

a first rigid conduit positioned in the drying circuit downstream of the first flexible conduit, the first rigid conduit conveying the drying airflow along a first direction;

a second rigid conduit positioned in the drying circuit downstream of the first rigid conduit, the second rigid conduit conveying the drying airflow along a second direction;

a second flexible conduit positioned in the drying circuit downstream of the second rigid conduit and wherein the first direction is transversal to the second direction, the angle defined by the first direction and the second direction being comprised between 60° and 105°, preferably between 75° and 90°, more preferably around 77.77°.

A twenty-fourth aspect of the disclosure, dependent on the twenty-third aspect, relates to a machine for drying laundry, in particular a washer-dryer, wherein the blower is positioned between the first rigid conduit and the second rigid conduit and/or wherein a housing for a filter assembly is defined in the first rigid conduit and/or wherein the condensing segment and the heating segment belong both to the second rigid conduit.

A twenty-fifth aspect of the disclosure, dependent on the twenty-third aspect or on the twenty-fourth aspect, relates to a machine for drying laundry, in particular a washer-dryer, the cabinet having a first side wall and a second side wall, wherein the second direction is substantially parallel to the first side wall and the second side wall, the distance separating the second rigid conduit from the first side wall being in particular greater than the distance separating the second rigid conduit from the second side wall.

A twenty-sixth aspect of the disclosure, dependent on any of the aspects from the sixteenth aspect to the twenty-fifth aspect, relates to a machine for drying laundry, in particular a washer-dryer, the cabinet comprising a top element comprising in turn a top wall, a first lateral wall and a second lateral wall, a space of containment being defined between the first lateral wall and the second lateral wall, wherein the drying circuit is in part housed in the space of containment, the height of the first lateral wall and of the second lateral wall being lower than 90 mm, preferably lower than 50 mm, more preferably around 66 mm.

A twenty-seventh aspect of the disclosure, dependent on the twenty-sixth aspect, relates to a machine for drying laundry, in particular a washer-dryer, wherein the evaporator and the condenser are both mounted inclined with respect to the top wall, so that the portion of the evaporator closer to the condenser is closer to the top wall than the portion of the evaporator farther to the condenser and the portion of the condenser closer to the evaporator is farther to the top wall than the portion of the condenser farther to the evaporator, wherein the tilt angle of the evaporator and/or the condenser with respect to a line orthogonal to the top wall is comprised between 1° and 30°, preferably between 3° and 15°, more preferably around 3.01°.

A twenty-eighth aspect of the disclosure, dependent on the twenty-seventh aspect, relates to a machine for drying laundry, in particular a washer-dryer, wherein the blower is mounted inclined with respect to the top wall as well, so that the portion of the blower closer to the evaporator is closer to the top wall than the portion of the blower farther to the evaporator, wherein the tilt angle of the rotation axis of the blower with respect to a line orthogonal to the top wall is comprised between 3° and 45°, preferably between 9° and 30°, more preferably around 13°.

A twenty-ninth aspect of the disclosure, dependent on any of the aspects from the sixteenth aspect to the twenty-eighth aspect, relates to a machine for drying laundry, in particular a washer-dryer, wherein the compressor is fixed to the cabinet by a supporting plate secured to the cabinet and by a plurality of brackets connecting the compressor to the supporting plate and wherein a damper is associated to the compressor, in particular damping feet being provided between the brackets and the supporting plate.

A thirtieth aspect of the disclosure, dependent on the twenty-ninth aspect, relates to a machine for drying laundry, in particular a washer-dryer, the cabinet having a rear wall, the machine further comprising a cooling fan, apt to move a cooling flow in the cabinet intended to reduce the temperature of the compressor, wherein the cooling fan is supported by the cabinet and is positioned adjacent to the rear wall, in particular adjacent to a perforated region of the rear wall.

BRIEF DESCRIPTION OF THE DRAWINGS

The aspects of the present disclosure listed above and further aspects of the present disclosures, together with respective purposes, characteristics and advantages will emerge clearly from the ensuing detailed description, with reference to the annexed drawings, which are provided purely by way of explanatory and non-limiting example and in which:

FIG. 17 to FIG. 22 are axonometric views and sectional views representing the switching of the configuration of the closure from the first configuration to the second configuration during the insertion of a filter according to the disclosure in a machine according to the disclosure.

DETAILED DESCRIPTION OF THE DRAWINGS

Figure 1:
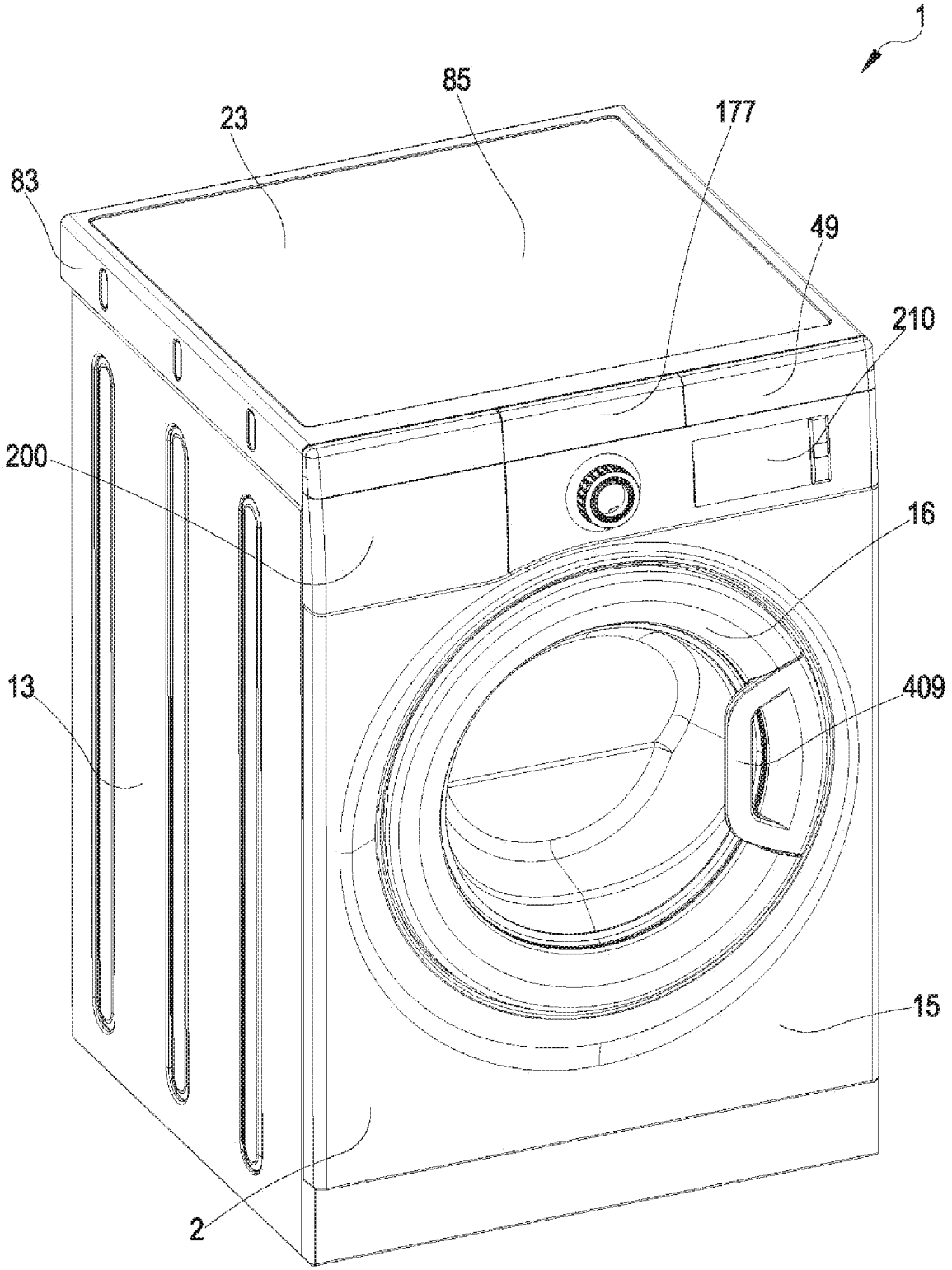
FIG. 1 is an axonometric view of a machine according to the disclosure.

In FIG. 1 a washer-dryer 1 is depicted. It should be clarified anyway that the disclosure can be implemented in any machine for drying laundry, and then is not limited to machines for drying laundry capable of executing washing cycles as well. In particular, the washer-dryer 1 is a front-loading machine, comprising a cabinet 2 and an oscillating assembly 3 housed in the cabinet 2.

Figure 4:
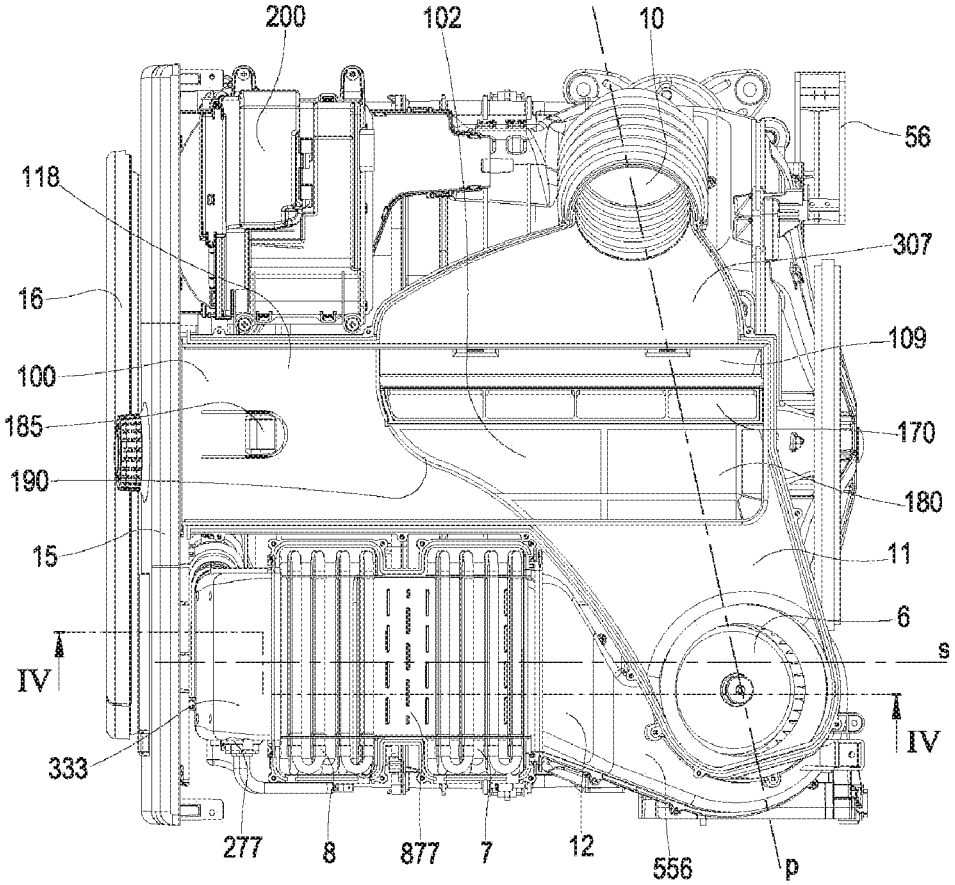
FIG. 4 is a plan view of the machine according to the disclosure, wherein same components of the machine are removed or made transparent in order to achieve a better visibility of the internal components.
Figure 5:
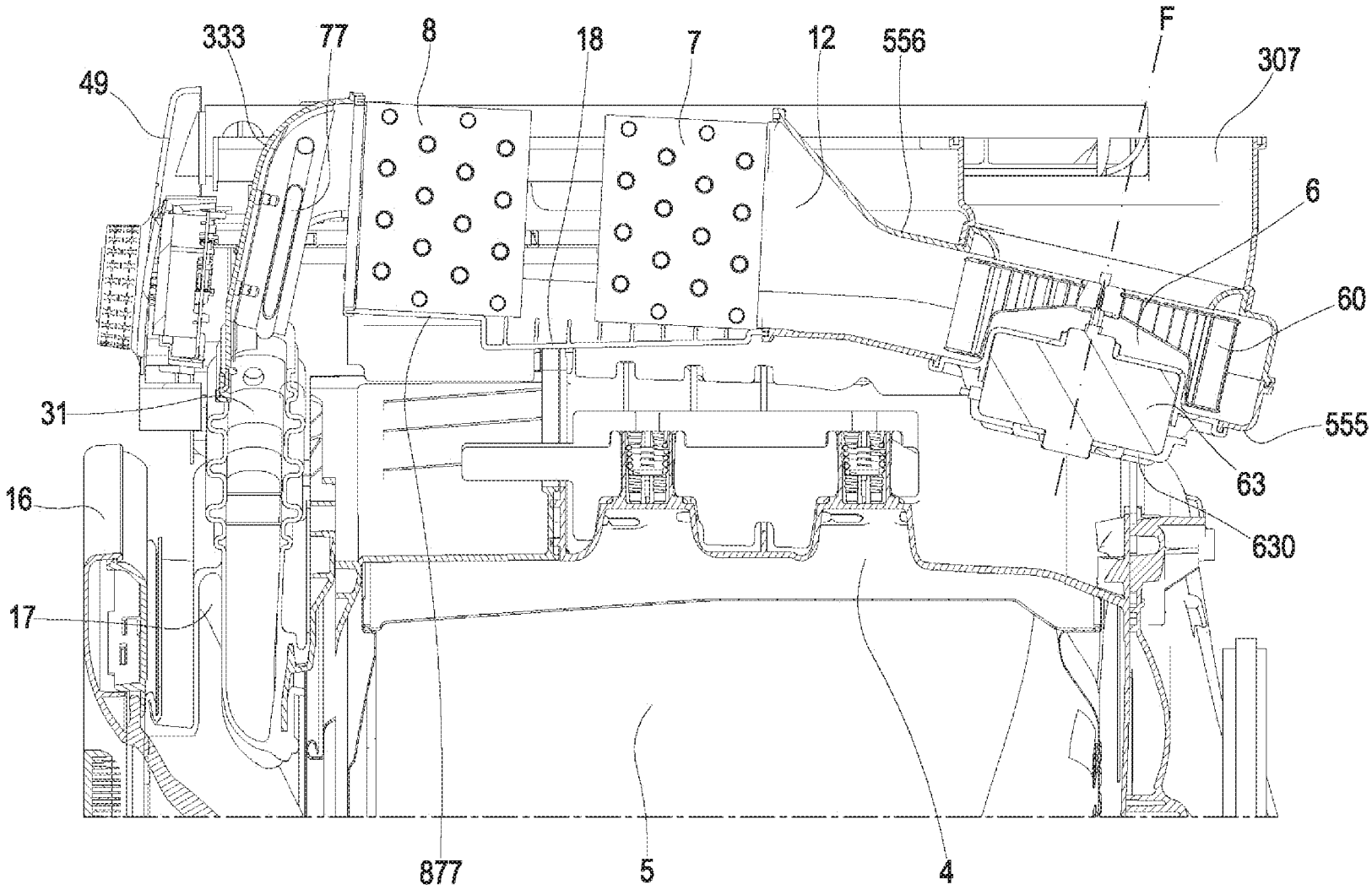
FIG. 5 is a lateral sectional view of the machine according to the disclosure, wherein same components of the machine are removed or made transparent in order to achieve a better visibility of the internal components.

Referring to FIGS. 4 and 5, the oscillating assembly 3 comprises a tub 4 and a drum 5, designed to contain the laundry to be washed and dried and rotatably mounted within the tub 4. The drum 5 has a substantially horizontal longitudinal axis (i.e. an axis having an inclination with respect to a horizontal plane comprised between 0° and 40°, preferably comprised between 0° and 15°).

Referring to FIG. 1, advantageously, the cabinet 2 has a front wall 15, a rear wall 21, a first side wall 13 and a second side wall 14 and comprises a top element 23, the top element 23 including the top wall 85 of the cabinet 2. A loading aperture communicating with the drum 5 being defined in the front wall 15, the loading aperture defined in the front wall 15 being associated to correspondent apertures defined in the tub 4 and in the drum 5 respectively. The machine comprises a door 16 apt to selectively close the loading aperture and a gasket 17 apt to seal the interspace between the front wall 15 and the door 16. A handle 409 is associated to the door 16 for allowing its opening.

The washer-dryer 1 comprises a drying circuit connected with the tub 4 at its ends, for generating and conveying a forced airflow and for heating the forced airflow. Advantageously, the washer-dryer 1 is machine for drying laundry of the condensation type and the drying circuit is substantially closed, i.e. configured for drawing in the moist air from the drum 5 and sending it back into the drum 5, after prior dehumidification and heating.

Referring to FIG. 5, for this purpose, a condensing segment and a heating segment are provided in the drying circuit, the dehumidification occurring in the condensing segment and the heating occurring in the heating segment. A forced airflow is moved in the drying circuit by means of a blower 6, so that the condensing segment is positioned in the drying circuit upstream of the heating segment. The blower 6 is preferentially a centrifugal one, with an impeller 60 driven by a substantially coaxial electric motor 63. At first, the moisture content in the drying airflow is reduced in the condensing segment and subsequently the temperature of the drying airflow is increased in the heating segment.

The washer-dryer 1 includes a heat pump system in order to benefit from the energy efficiency advantages made possible by the implementation of the heat pump technology in washer-dryers. Besides the drying circuit designed for the circulation of the drying airflow, the washer-dryer 1 further includes hence a closed circuit designed for the circulation of a flow of a working fluid (i.e. a refrigerant as R134a). According to the heat pump technology, thermal exchanges occur between the drying airflow circuit and the working fluid circuit.

The heat pump system includes an evaporator 7 (housed in the condensing segment), a compressor 9 and a condenser 8 (housed in the heating segment). In the evaporator 7, the working fluid changes from a liquid to a gas by absorbing heat from the drying airflow that is consequently cooled. Hence the heat absorbed by the working fluid at the evaporator 7 causes the desired extraction of moisture (in the form of condensed water) from the drying airflow. In the compressor 9, the pressure and the temperature of the working fluid are increased, so that the working fluid is released from the compressor 9 as a superheated vapor. In the condenser 8, the working fluid changes from a gas to a liquid by transferring heat to the drying airflow that is consequently heated. Hence the drying airflow, previously cooled by the evaporator 7, becomes hot and dry at the condenser 8 (and consequently ready to extract further moisture from the laundry loaded in the drum 5).

The evaporator 7 and the condenser 8 have an appropriate heat exchange surface area and may both be provided as finned-pack heat exchangers or as micro-channel heat exchangers (the evaporator 7 and the condenser 8 may comprise both a single heat exchanger, as depicted in the Figures, or otherwise the evaporator 7 and/or the condenser 8 may include two or more distinct heat exchangers connected in series). The evaporator 7 and the condenser 8 have respective bodies configured for being traversed by the drying airflow. Preferentially, the bodies of the evaporator 7 and/or of the condenser 8 have a generally parallelepipedal or prismatic shape, with an inlet end and an outlet end opposite to one another for the drying airflow, as well as two lateral ends opposite to one another and set transversely with respect to the inlet end and the outlet end. The distance between the evaporator 7 and the condenser 8 is such that the total encumbrance of the heat exchangers is optimized without jeopardizing a clear separation between the condensing segment and the heating segment. The condenser 8 may be connected to the evaporator 7 by means of a capillary tube (not represented in the Figures) that properly reduces the temperature and the pressure of the working fluid at the entry of the evaporator 7. Instead of the capillary tube, a different expansion device may be used for reducing the temperature and the pressure of the working fluid between the condenser 8 and the evaporator 7, e.g. a lamination valve.

The compressor 9 may be a volumetric compressor wherein the temperature and the pressure of the working fluid are increased by means of a piston driven by an electric motor. Advantageously, the compressor 9 is a variable speed compressor, since this kind of compressor allows a modulation of the heating and cooling capacities of the working fluid circuit, and then a substantial increase of the energy efficiency of the washer-dryer 1. Since the compressor 9 gets hot to some extent during the operation, a cooling fan 56 is advantageously associated to the compressor 9, the cooling fan 56 being apt to move a cooling flow in the cabinet 2 intended to reduce the temperature of the compressor 9.

Figure 3:
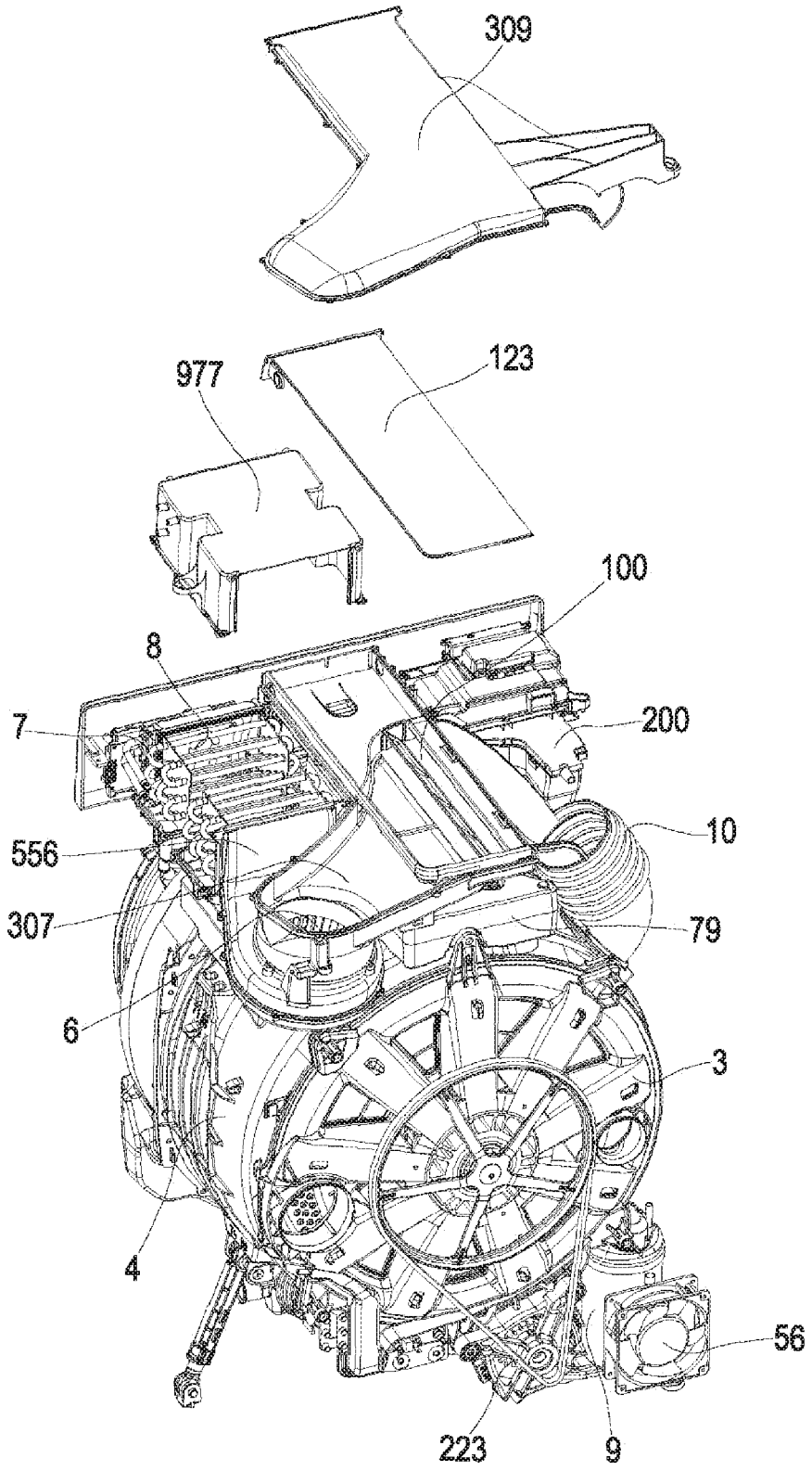

Referring to FIG. 3, the washer-dryer 1 further comprises a filter assembly 100 acting as a separator of the fluff from the drying airflow carrying the fluff. The filter assembly 100 is advantageously housed in a removable manner in the washer-dryer 1, preferably in a slot internal to the cabinet 2 and communicating with the drying circuit. Because the configuration of the filter assembly 100 according to the present disclosure constitutes per se an innovative technical solution, a very detailed description of the filter assembly 100 and of its operation is provided below.

Apart from all components cited above and apart from the components belonging to or associated with the drying airflow circuit and/or the working fluid circuit, the washer-dryer 1 forming the subject of the disclosure comprises further components for operating as a machine designed for carrying out washing and drying operations, e.g. the washing agents dispenser 200 and/or the user interface 210 and/or the electric motor 223 coupled to the drum 5. Since these further components are of a conception in itself known, they will not be described in particular detail.

According to the present disclosure, the evaporator 7, the condenser 8 and the compressor 9 are all supported by the cabinet 2. Advantageously, all the components of the heat pump system and/or all the components associated with the working fluid circuit are supported by the cabinet 2. In such a way, the heat pump system is firmly and reliably fixed to the washer-dryer 1. The position of the components of the heat pump system remains substantially stable regardless of the movements made by the oscillating assembly 3, in particular by the tub 4. Consequently the wear of the heat pump system is strongly prevented and the occurrence of possible damages to the heat pump system and in general to the washer-dryer 1 is significantly reduced.

According to the present disclosure, the evaporator 7 and the condenser 8 are both positioned substantially above the drum 5, whilst the compressor 9 is positioned substantially below the drum 5. Advantageously the evaporator 7 and the condenser 8 are both positioned substantially above the tub 4. Advantageously the compressor 9 is positioned substantially below the tub 4. In such a way, the room available in the cabinet 2 for the housing of the drying airflow circuit and/or the heat pump system is exploited at best. Moreover the total encumbrance of the drying facilities of the washer-dryer 1 and consequently of the cabinet 2 are all optimized.

It should be underlined that in the description and in the claims the expressions "positioned substantially above" and "positioned substantially below" are used.

If a first device (e.g. the evaporator 7 or the condenser 8) is said to be positioned substantially above a second device (e.g. the drum 5 or the tub 4), it means that more than half of the volume of the first device is positioned above the highest point of the second device, preferably more than two thirds of the volume of the first device are positioned above the highest point of the second device, still more preferably the volume of the first device is positioned completely above the highest point of the second device.

At the contrary, if a first device (e.g. the compressor 9) is said to be positioned substantially below a second device (e.g. the drum 5 or the tub 4), it means that more than half of the volume of the first device is positioned below the lowest point of the second device, preferably more than two thirds of the volume of the first device are positioned below the lowest point of the second device, still more preferably the volume of the first device is positioned completely below the lowest point of the second device.

According to the present disclosure, the compressor 9 is connected to the evaporator 7 and to the condenser 8 by means of flexible pipes. The use of flexible pipes for the connection between the compressor 9 (positioned substantially below the drum 5 and hence at the bottom of the volume internal to cabinet 2) and the heat exchangers (positioned both substantially above the drum 5 and hence at the top of the volume internal to cabinet 2) is highly advantageous, because the flexible pipes allow the connection among these components to be easily and securely established despite the quite tortuous path to be necessarily followed. Furthermore, the flexible pipes, during the operation of the washer-dryer 1, are not subjected to ruptures and/or failures due to the vibrations of the oscillating group 3.

Figure 6:
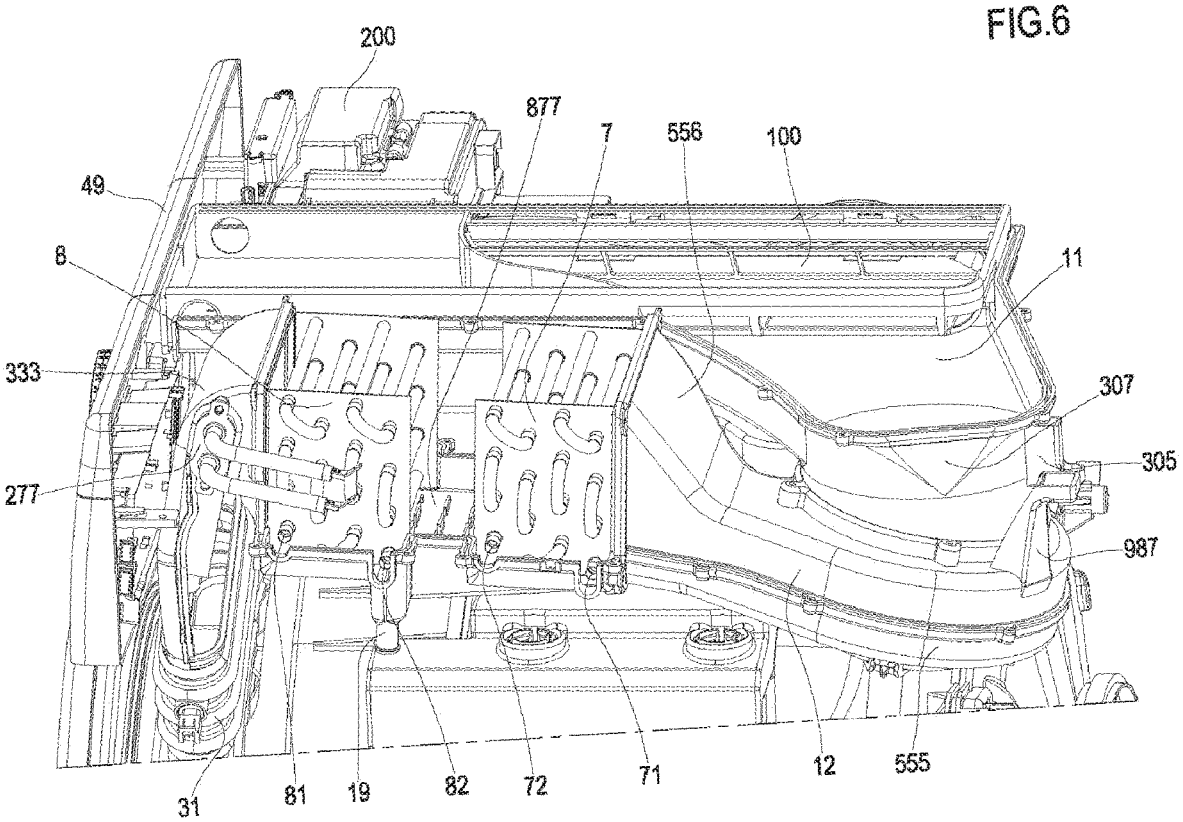
FIG. 6 is an axonometric view of the machine according to the disclosure, wherein same components of the machine are removed or made transparent in order to achieve a better visibility of the internal components.
Figure 7:
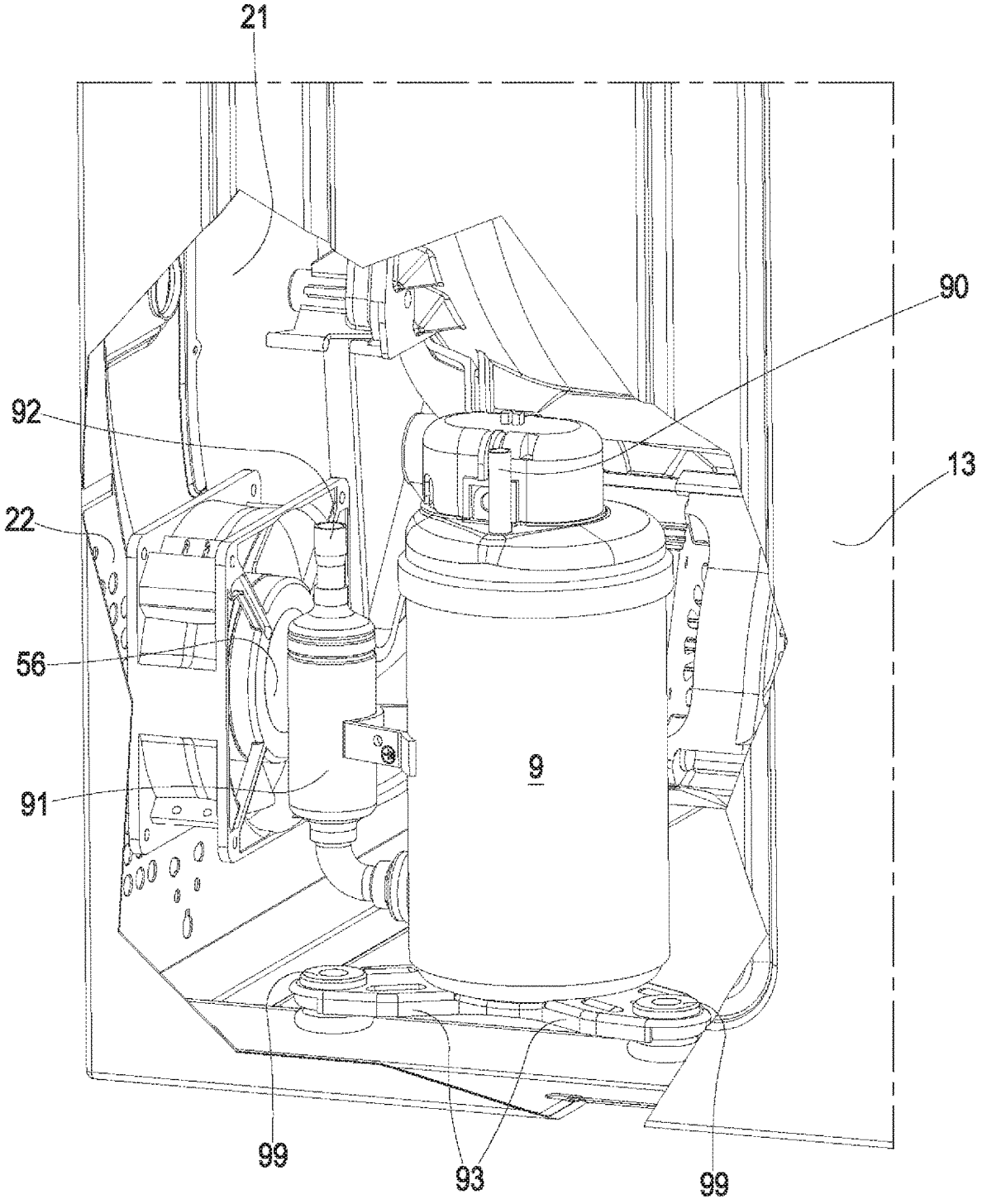
FIG. 7 is an axonometric view of a detail of the machine according to the disclosure, the detail showing the compressor and the cooling fan associated to the compressor.

As may be appreciated in FIG. 7 that detailedly shows the compressor 9, a delivery plug 90 is provided at the outlet of the compressor compartment. Upstream of the compressor compartment, advantageously the compressor 9 includes a dehydrating filter 91 apt to separate possible particles of liquid from the working fluid. A suction plug 92 is provided at the inlet of the dehydrating filter 91. The delivery plug 90 is configured for being tightly connected to a first end of a first flexible pipe (not represented in the Figures) whose second end is tightly connected to the inlet section 81 of the condenser 8, whilst the suction plug 92 is configured for being tightly connected to a second end of a second flexible pipe (not represented in the Figures) whose first end is tightly connected to the outlet section 71 of the evaporator 7. The inlet section 81 of the condenser 8 and the outlet section 71 of the evaporator 7 are both clearly visible in FIG. 6, that shows as well the outlet section 82 of the condenser 8 and the inlet section 81 of the evaporator 7 adequately connected to each other, e.g. via a capillary tube.

Advantageously, also the blower 6 is supported by the cabinet 2 in order to achieve a firm and reliable fixing of the blower 6 to the washer-dryer 1. The blower 6 is positioned substantially above the drum 5, i.e. close to the evaporator 7 and to the condenser 8, so that a compact drying circuit is obtained. In the exemplary embodiment depicted in the Figures, the blower 6 is positioned upstream of the condensing segment, i.e. upstream of the evaporator 7 and of the condenser 8. However, the blower 6 can be positioned along the drying circuit between the condensing segment and the heating segment, i.e. between the evaporator 7 and the condenser 8, or otherwise downstream of the heating segment, i.e. downstream of the evaporator 7 and of the condenser 8. The filter assembly 100 (associated to the drying circuit for separating possible fluff from the drying airflow that carries the fluff) is installed upstream of the blower 6 and of all functional components provided in the drying circuit (e.g. the evaporator 7 and the condenser 8) in order to safeguard the blower 6 and of all functional components provided in the drying circuit from possible damages due to the presence of fluff in the drying airflow.

Besides the filtering of the fluff, a proper functioning of the drying circuit entails the drainage of the condensed water collected in the condensing segment due to the condensation of the moisture in the drying airflow coming into contact with the evaporator 7. Therefore a drain or draining means are provided in the condensing segment for draining the condensed water. The drain comprises at least one draining hole 19 tightly connected to the tub 4 by means of a flexible hose (not represented in the Figures). The condensed water is hence conveyed at first (by gravity only or by using an actuator, e.g. a peristaltic pump) from the condensing segment to the tub 4 (preferably to a bottom portion of the tub 4 to avoid wetting the laundry in the drum 5) via the dedicated flexible hose and then is discharged from the washer-dryer 1 by means of the same draining facilities (in particular by means of the same pump) used for discharging the washing liquid after a washing cycle.

It is well known that heat pump systems on the one hand are optimal from an energy efficiency point of view, but on the other hand they need a sufficiently long time to reach the steady state conditions. Therefore an electric heater 77 is advantageously provided in the electric heater 77, the electric heater 77 being in particular positioned downstream of the condenser 8. The electric heater 77 is effective during the initial transitional period of the heat pump circuit. Indeed the activation of the electric heater 77 in the first stage of the laundry drying process significantly quickens the reaching of the desired drying airflow temperature. The electric heater 77 is effective as well even when the heat pump circuit operates at full capacity (i.e. after the reaching of the steady state conditions). Indeed a continuous or intermittent activation of the electric heater 77 increases appreciably the quantity of heat available for the laundry drying process. As overall effect, the electric heater 77 acts as a "booster", increasing the performances of the washer-dryer 1 and shortening the duration of the laundry drying process.

The activation of the electric heater 77 may be manual. One or more dedicated selectors are provided in the user interface 210 to allow the user to select, for instance, the switching-on of the electric heater 77 and/or the operational mode of the electric heater 77 (continuous or intermittent) and/or the execution of a fast treatment cycle that requires a high quantity of heat during the laundry drying process since the cycle has to terminate in a relatively short time. The activation of the electric heater 77 may be automatic as well. The electronic control system of the washer-dryer 1 commands the switching-on and the switching-off of the electric heater 77 (and a possible regulation of its heating power) depending on the needs of the drying circuit. Just for the sake of giving an example, the electric heater 77 may be activated at its maximum heating power until a predetermined temperature is reached in the drying circuit, then activated at its minimum heating power for a predetermined time and finally switched-off.

The evaporator 7 and/or the condenser 8 are advantageously arranged both according to inclined planes, in order to obtain wider surfaces of heat exchange. With particular regard to the evaporator 7, an inclined arrangement further facilitates the outflow of the condensed water from the surface of the evaporator 7. In the exemplary embodiment shown in the Figures, the evaporator 7 and the condenser 8 are both mounted inclined with respect to the top wall 85, so that the portion of the evaporator 7 closer to the condenser 8 is closer to the top wall 85 of the cabinet 2 than the portion of the evaporator 7 farther to the condenser 8. The portion of the condenser 8 closer to the evaporator 7 is instead farther to the top wall 85 than the portion of the condenser 8 farther to the evaporator 7.

The tilt angle of the evaporator 7 and/or the condenser 8 with respect to a line orthogonal to the top wall 85 is comprised between 1° and 30°, preferably between 3° and 15°, more preferably around 3.01°. Advantageously, the tilt angle of the evaporator 7 is substantially equal to the tilt angle of the condenser 8, in order to allow the drying airflow to follow a straight direction from the evaporator 7 to the condenser 8, so avoiding localized load losses.

In order to allow the mounting of an impeller 60 having a larger diameter, the blower 6 as well is advantageously mounted inclined with respect to the top wall 85 of the cabinet 2. In the exemplary embodiment shown in the Figures, the portion of the blower 6 closer to the evaporator 7 is closer to the top wall 85 than the portion of the blower 6 farther to the evaporator 7. The tilt angle of the rotation axis F of the blower 6 with respect to a line orthogonal to the top wall 85 is comprised between 3° and 45°, preferably between 9° and 30°, more preferably around 13°.

Figure 8:
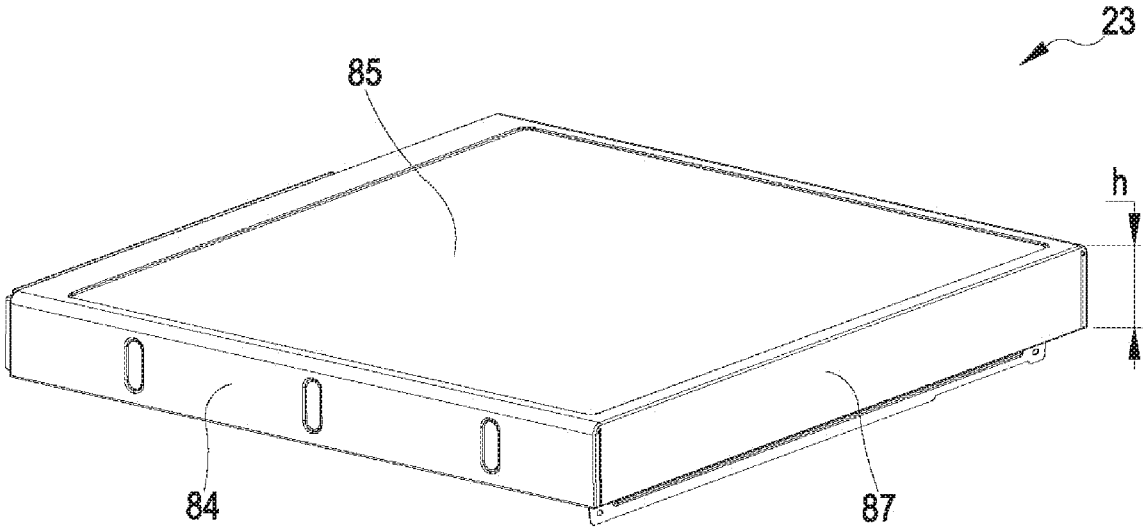
FIG. 8 is an axonometric view of the top element included in the machine according to the disclosure.

Advantageously, the top element 23 is configured for increasing the volume of the cabinet 2, in particular for increasing the volume of the cabinet 2 above the oscillating group 3, and consequently for reducing, during the operation of the washer-dryer 1, especially during the spinning, the risks of impact between the oscillating group 3 and the components associated to the drying circuit. Such a configuration of the top element 23 may be appreciated in particular in the representation provided in FIG. 8. Beside the top wall 85, the top element 23 further comprises a first lateral wall 83 (positioned adjacent to the first side wall 13 of the cabinet 2 when the top element 23 is assembled to the rest of the cabinet 2), a second lateral wall 84 (positioned adjacent to the second side wall 14 of the cabinet 2 when the top element 23 is assembled to the rest of the cabinet 2) and optionally a back wall 87 (positioned adjacent to the rear wall 21 of the cabinet 2 when the top element 23 is assembled to the rest of the cabinet 2). A space of containment is hence defined between the first lateral wall 83 and the second lateral wall 84 of the top element 23, this space of containment being open downwards and then communicating with the volume internal to the rest of the cabinet 2 when the top element 23 is assembled to the rest of the cabinet 2. Therefore the intended increase in the volume of the cabinet 2, in particular in the volume of the cabinet 2 above the oscillating group 3, is achieved because of the configuration of the top element 23 and the space of containment can be effectively exploited for housing a portion of the drying circuit and/or of its functional components.

In order to obtain a cabinet 2 having a substantially standardized encumbrance, the space of containment internal to the top element 23 advantageously does not exceed the dimensions sufficient for allowing the cabinet 2 to properly house and support the drying circuit. In particular, the height h of the first lateral wall 83 of the top element 23 (substantially equal to the height of the second lateral wall 84 and to the height of the possible back wall 87) is lower than 90 mm, preferably lower than 50 mm, more preferably around 66 mm.

In order to increase the stiffness of the structure of the cabinet 2 (in particular of the top wall 85), a cross bar connecting the first lateral wall 83 with the second lateral wall 84 may be provided under the top wall 85. This cross bar may be conveniently exploited also for the fixing of the drying circuit and of its components.

FIG. 7 shows a possible fixing of the compressor 9 to the cabinet 2 according to the present disclosure. The compressor 9 is located at the bottom of the cabinet 2, in particular near to the edge defined by the first side wall 13 of the cabinet 2 and the rear wall 21 of the cabinet 2. The compressor 9 is positioned on a supporting plate 97 (preferably substantially horizontal), the supporting plate 97 being fixed (e.g. welded or riveted or screwed) to the walls of the cabinet 2, in particular to the first side wall 13 or to the rear wall 21. A plurality of brackets 93 (preferably three substantially equally distanced brackets) are associated to the compressor 9, the brackets 93 being securely anchored to the supporting plate 97.

In order to avoid the propagation of the vibrations generated by the compressor 9 during its operation, dampening means are associated to the compressor 9, in particular interposed between the compressor 9 and the supporting plate 97 and/or between the supporting plate 97 and the cabinet 2. In the exemplary embodiment depicted in FIG. 7, the dampening means comprise damping feet 99 provided between the brackets 93 and the supporting plate 97. The damping feet 99 (being made of an elastic and/or soft material, e.g. rubber) significantly cushion the vibrations transmitted from the brackets 93 and the supporting plate 97, so improving the silentness and the durability of the washer-dryer 1.

FIG. 7 shows as well a possible fixing of the cooling fan 56 configured for cooling the compressor 9 during its operation. The cooling fan 56 is supported as well by the cabinet 2, in particular welded or riveted or screwed. Advantageously, the cooling fan 56 is fixed by means of screws to the rear wall 21 of the cabinet 2 and is positioned adjacent to a perforated region 22 of the rear wall 21. The perforations of the perforated region 22 allow the cooling fan 56 to suck from outside a volume of fresh air sufficient to maintain the temperature of the compressor 9 during the operation below a fixed threshold.

An exemplary embodiment of the drying circuit is depicted in the Figures. As can be noted especially by the representation in FIG. 4, the drying circuit as a whole has a generally L-shaped configuration, since initially it extends adjacently to the rear wall 21 of the cabinet 2, then it extends adjacently to the second side wall 14. This configuration fits with the spaces that have to be reserved above the drum 5 to components of the washer-dryer 1 like the counterweights 79 and the washing agents dispenser 200.

Advantageously the drying circuit is composed of rigid conduits, that define the greater part of the extension of the drying circuit and that house the most functional components associated to the drying circuit, and of flexible conduits, that allow a tightly connection between the rigid conduits and the tub 4. The rigid conduits are hollow bodies formed by the tightly joining of several elements made of thermoplastic material (having adequate properties of resistance to the heat and to the humidity) and/or metallic material. The rigid conduits hence comprise at least a first semi-shell and a second semi-shell joined together. Advantageously the rigid conduits are supported by the cabinet 2. The flexible conduits are hollow bodies made of a thermoplastic material having adequate elasticity and adequate properties of resistance to the heat and to the humidity. Advantageously, the flexible conduits are enbloc elements.

The drying airflow exits from the tub 4 through an outlet aperture positioned in the top portion of the tub 4, preferably at a height greater than the maximum height that the washing liquid can reach during the washing. A first flexible conduit 10, in the form of a bellows-type tube, is tightly connected to the outlet aperture of the tub 4. The end of the first flexible conduit 10 opposite to the end connected to the tub 4 is connected to the inlet mouth of a first rigid conduit 11. The first flexible conduit 10 extends mainly along the vertical direction. Since the first flexible conduit 10 connects two elements having relative movement during the operation of the washer-dryer 1 (especially during the spinning), the first flexible conduit 10 is capable of considerable variations in length, so that the first rigid conduit 11 always remains tightly connected to the tub 4.

The first rigid conduit 11 has a roughly flat configuration and is positioned just below the top wall 85. The first rigid conduit 11 comprises two main elements, i.e. a lower element 307 and an upper element 309, tightly connected each other preferably by means of screws. The lower element 307 and the upper element 309 could be both fixed to the cabinet 2, as in the exemplary embodiment depicted in the Figures. Preferably, fixing means, configured for allowing the fixing to the cabinet 2, are integral to the lower element 307 and to the upper element 309 as well, so that a more stable and secure fixing of the first rigid conduit 11 is obtained. In particular, the fixing means are configured for allowing the fixing of the respective component to an edge of the cabinet 2, preferably in correspondence with the interface of the walls of the cabinet 2 with the top element 23.

Figure 9:
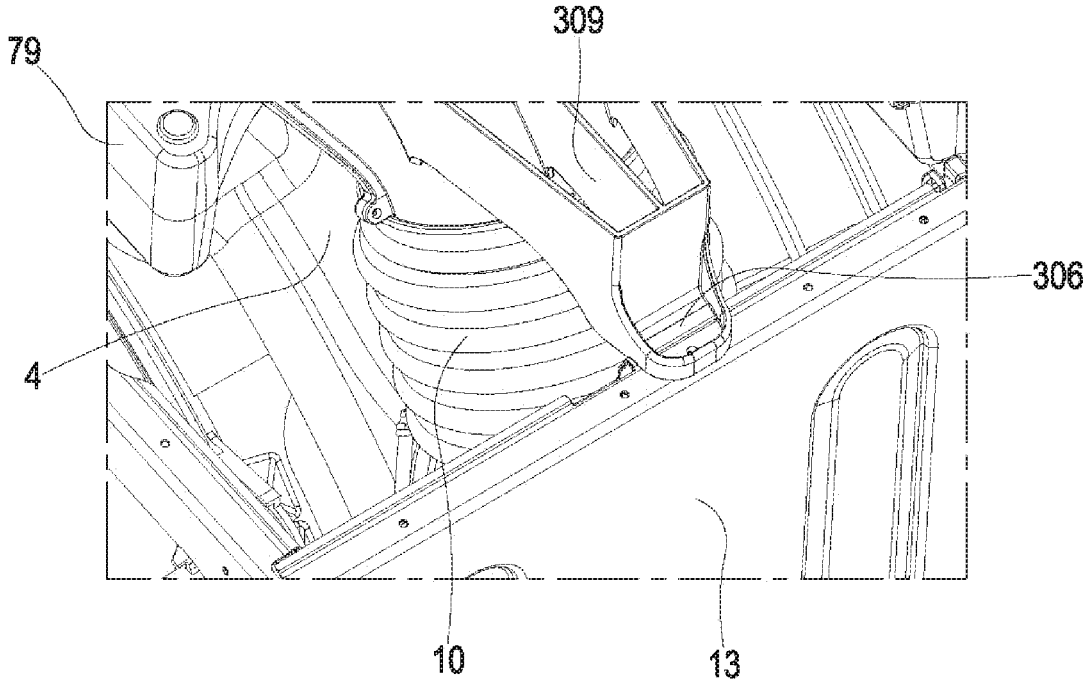
FIG. 9 and FIG. 10 are axonometric views of further details of the machine according to the disclosure, the further details showing the fixing of some components of the drying circuit.
Figure 10:
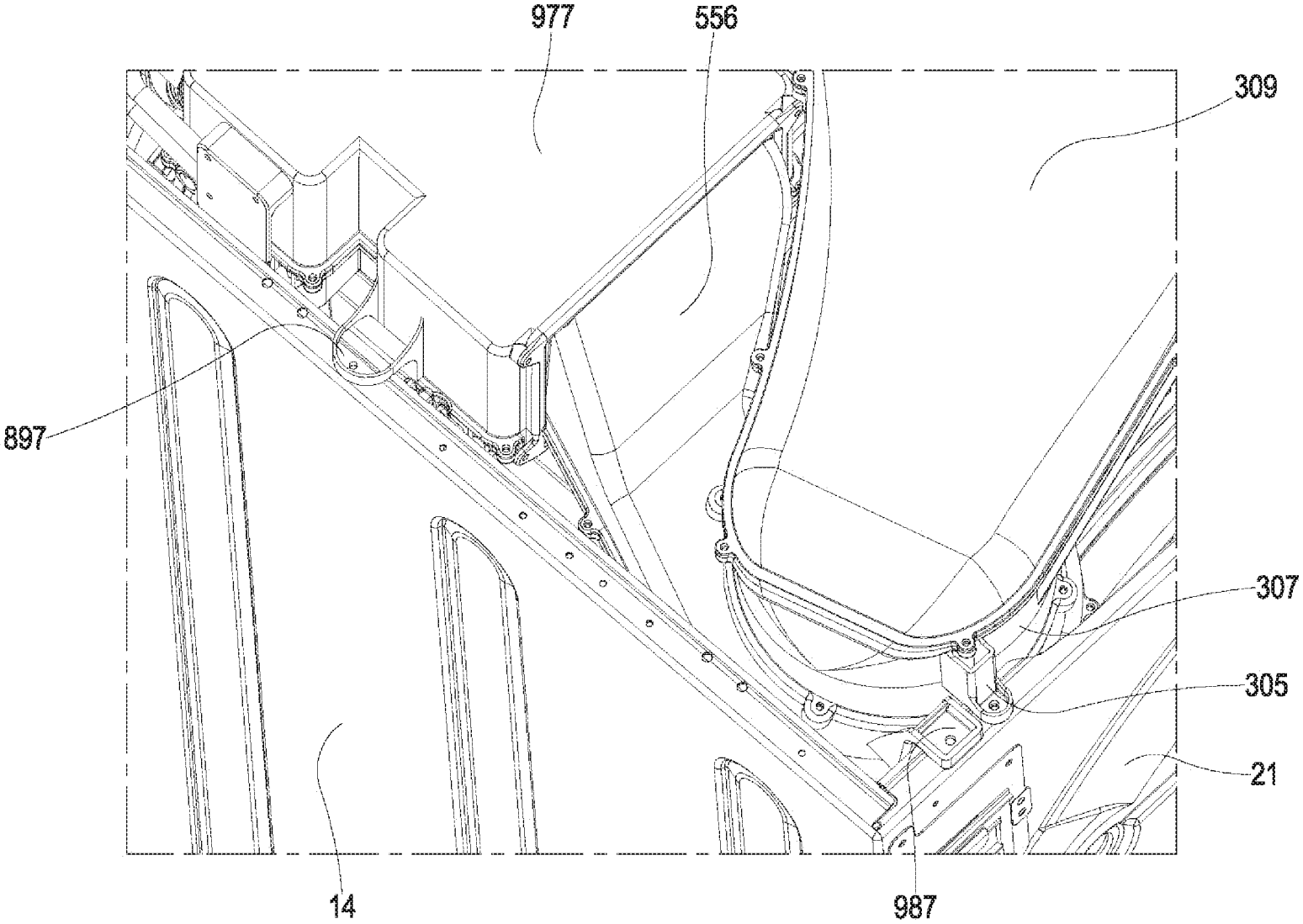

The anchorage of the fixing means 306 of the upper element 309 to the upper edge of the first side wall 13 of the cabinet 2 (completed my means of or more screws) is represented in detail in FIG. 9, whilst the anchorage of the fixing means 305 of the lower element 307 to the upper edge of the rear wall 21 of the cabinet 2 (completed my means of or more screws) is represented in detail in FIG. 10. As an alternative to such a fixing arrangement, only the lower element 307 could be fixed directly to the cabinet 2, the upper element 309 being fixed indirectly to the cabinet 2 via the lower element 307.

A housing for the filter assembly 100 is defined in the first rigid conduit 11, in particular in an intermediate portion of the first rigid conduit 11. The housing in the first rigid conduit 11 is integral to (in particular constitutes a portion of) a slot in the cabinet 2 wherein the filter assembly 100 is fully housed (preferably in a removable manner). To allow the communication between the housing in the first rigid conduit 11 and the remaining portion of the slot (and consequently the insertion of the filter assembly 100 in the washer-dryer 1 along the direction represented by the arrow in FIG. 14), the lateral wall of the first rigid conduit 11 facing towards the front wall 15 of the cabinet 2 is interrupted in an intermediate portion. As clearly shown in FIG. 4, the continuity of the lateral wall of the first rigid conduit 11 facing towards the front wall 15 is reinstated by a deflector 190 provided in the filter assembly 100 when the filter assembly 100 is housed in the slot provided in the cabinet 2.

In order to allow an optimal filtering of the drying airflow, the first rigid conduit 11 has advantageously its maximum width in correspondence with the housing for the filter assembly 100. Therefore the first rigid conduit 11, as clearly shown even in FIG. 4, envisages a divergent stretch upstream of the filter assembly 100 and a convergent stretch downstream of the filter assembly 100. Such a configuration of the first rigid conduit 11 allows the speed of the drying airflow to be really low in correspondence with the filter assembly 100, so allowing the filter assembly 100 to act more effectively on the drying airflow. Advantageously the bottom of the first rigid conduit 11 (in particular of the lower element 307) is lowered downstream of the filter, for allowing also the bottom surface of the filter assembly 100 to be exploited as filtering surface.

The first rigid conduit 11 terminates in correspondence with the blower 6. In order to allow the fluid communication with the blower 6 and with a second rigid conduit 12 disposed downstream of the blower 6, an outlet mouth is provided at the end of the first rigid conduit 11 adjacent to the second side wall 14, the outlet mouth being in particular obtained in the lower element 307 and being preferably inclined (as shown in FIG. 5) with respect to the top wall 85 of the cabinet 2, so facilitating the blower 6 to be mounted inclined as well.

In the exemplary embodiment depicted in FIG. 5, the impeller 60 of the blower 6 is housed in the inlet portion of the second rigid conduit 12. The electric motor 63 of the blower 6 is enclosed in a casing 630, the casing 630 being fixed to the second rigid conduit 12 (in particular screwed or clamped or welded to the inlet portion of the second rigid conduit 12) so that the impeller 60 coupled to the electric motor 63 faces the outlet mouth of the first rigid conduit 11. The casing 630 allows the electric motor 63 to be conveniently positioned on the outside of the second rigid conduit 2, in a position isolated with respect to the drying airflow.

The blower 6 is then fixed indirectly to the cabinet 2, since the blower 6 is fixed to the second rigid conduit 12 and the second rigid conduit 12 is in turn fixed to the cabinet 2. As an alternative to the exemplary embodiment depicted in FIG. 5, the blower 6 is enclosed in a dedicate casing wherein the impeller 60 is contained and that is interposed between the first rigid conduit 11 and the second rigid conduit 12, the dedicate casing being possibly fixed directly to the cabinet 2.

As shown for instance in FIG. 5, the second rigid conduit 12 is conveniently made up of a plurality of rigid elements properly connected to each other and to the cabinet 2. The second rigid conduit 12 is indeed formed in a number of box-shaped parts assembled together (in particular screwed or clamped or welded) in a fluid-tight way.

The condensing segment and the heating segment belong both to the second rigid conduit 12. Therefore the evaporator 7, the condenser 8 and the possible electric heater 77 are all housed in the second rigid conduit 12.

The relative disposition between the first rigid conduit 11 and the second rigid conduit 12 is shown in FIG. 4, wherein the first direction p represents roughly the direction along which the drying airflow is prevalently conveyed along the first rigid conduit 11, whilst the second direction s represents roughly the direction along which the drying airflow is prevalently conveyed along the second rigid conduit 12. The first direction p is transversal to the second direction s, the angle defined by the first direction p and the second direction s being comprised between 60° and 105°, preferably between 75° and 90°, more preferably around 77.77°. This relative disposition fits with the kind of blower 6 (i.e. a centrifugal blower) positioned between the first rigid conduit 11 and the second rigid conduit 12. Advantageously, the second direction s is substantially parallel to the first side wall 13 and to the second side wall 14 of the cabinet 2.

The second rigid conduit 12 preferably extends adjacently to the second side wall 14 of the cabinet 12, the distance separating the second rigid conduit 12 from the first side wall 13 so being significantly greater than the distance separating the second rigid conduit 12 from the second side wall 14. The lateral positioning of the second rigid conduit 12 is highly functional to get an optimization in the use of the space available in the cabinet 2 above the oscillating group 3, since enough room is left for the washing agents dispenser 200 (near the first side wall 13) and for the slot housing the filter assembly 100 (at the middle).

The inlet portion of the second rigid conduit 12 defines a volute for the impeller 60 of the blower 6. The inlet portion of the second rigid conduit 12 comprises a lower element 555 and an upper element 556. Means for fixing the casing 630 of the electric motor 63 of the blower 6 are associated to the lower element 555 of the inlet portion of the second rigid conduit 12. An inlet mouth for the second rigid conduit 12 is obtained in the upper element 556 of the inlet portion of the second rigid conduit 12, the shape of the inlet mouth of the second rigid conduit 12 being conjugated with the shape of the outlet mouth of the first rigid conduit 11, in order to obtain a tight coupling between the first rigid conduit 11 and the second rigid conduit 12. As clearly visible in FIG. 10, fixing means 987 are associated in particular to the inlet portion of the second rigid conduit 12, in particular to the upper element 555. Advantageously, the fixing means 987 are integral to the upper element 555 and comprise a protrusion extending adjacently to the inlet mouth of the second rigid conduit 12 and a substantially horizontal resting surface at the end of the protrusion. The fixing means 987 are configured for anchoring (preferably by means of one or more screws) the inlet portion of the second rigid conduit 12 to the upper edge of the rear wall 21 of the cabinet 2.

The intermediate portion of the second rigid conduit 12 is configured for providing internally enough room for the housing of the evaporator 7 and of the condenser 8. The intermediate portion of the second rigid conduit 12 comprises a lower element 877 and an upper element 977. As can be appreciated in particular by the representation in FIG. 3, the respective shapes of the lower element 877 and of the upper element 977 are functional to facilitate possible maintenance operations interesting the heat exchangers. In particular, the lateral walls of the intermediate portion of the second rigid conduit 12 belong both to the upper element 977, so that in possible maintenance operations full access to the evaporator 7 and to the condenser 8 can be easily achieved by means of a simple removal of the upper element 977 from the second rigid conduit 12.

Figure 11:
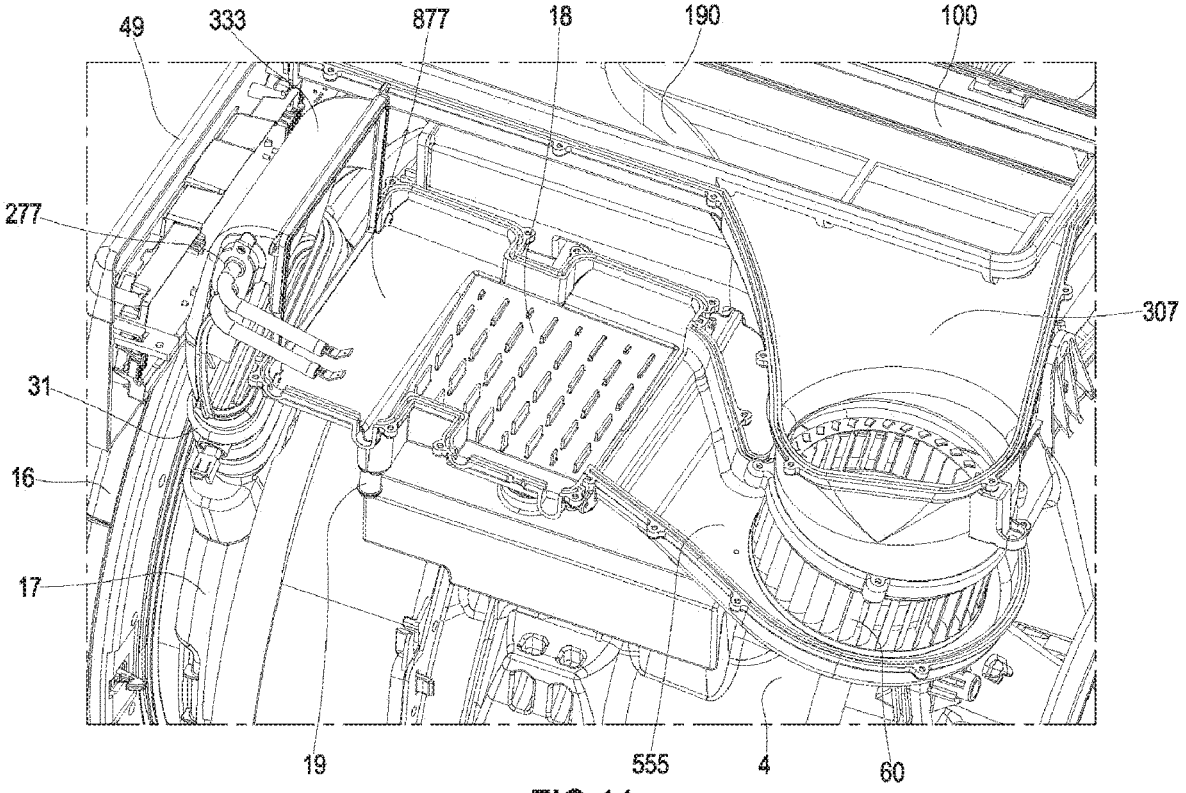
FIG. 11 is an axonometric view of a further detail of the machine according to the disclosure, the detail showing the rigid conduits of the drying circuit.

The lower element 877 instead is configured for providing a drain at the bottom of the intermediate portion of the second rigid conduit 12. In particular the lower element 877 comprises an inclined portion 18 substantially below the evaporator 7, the inclined portion 18 being adjacent to the draining hole 19 and acting a funnel for conveying, via the draining hole 19, the condensing water coming from the evaporator 7 to the flexible hose connected to the tub 4. Advantageously, the draining hole 19 is positioned in the region of the lower element 877 adjacent to the second side wall 14 of the cabinet 2. As can be appreciated especially in FIG. 11, a spacer or spacing means advantageously protrude from the inclined portion 18 in order to support the evaporator 7 at a proper distance from the draining hole 19, so that a small collection of condensed water in the intermediate portion of the second rigid conduit 12 cannot jeopardize a correct operation of the drying circuit.

As clearly visible in FIG. 10, fixing means 897 are associated in particular to the intermediate portion of the second rigid conduit 12, in particular to the upper element 977. Advantageously, the fixing means 897 are integral to the upper element 977 and are configured for anchoring (preferably by means of one or more screws) the intermediate portion of the second rigid conduit 12 to the upper edge of the second side wall 14 of the cabinet 2. The coupling between the lower element 877 and the upper element 977 of the intermediate portion of the second rigid conduit 12 allows the intermediate portion of the second rigid conduit 12 to be passed through by both flexible pipes connecting the heat exchangers with the compressor 9 and by the capillary tube connecting the condenser 8 with the evaporator 7. Indeed the adjacent edges of the lower element 877 and the upper element 977 have respective profiles allowing openings for the flexible pipes and the capillary tube to be defined in the intermediate portion of the second rigid conduit 12 when the lower element 877 is connected to the upper element 977 (as can be unequivocally inferred from the representation in FIG. 6).

The outlet portion of the second rigid conduit 12 is configured for deviating the direction of the drying airflow from a substantially horizontal airflow to a substantially vertical airflow. The outlet portion of the second rigid conduit 12 comprises a lower element (not represented in the Figures) and an upper element 333. The room of the outlet portion is adjacent to the room of the intermediate portion wherein the condenser 8 is housed and then is conveniently used for increasing the heating segment with the housing of the electric heater 77.

The mounting plate 277 supporting the electric heater 77 is anchored (preferably by means of screws) to the side of the outlet portion of the second rigid conduit 12 faced towards the second side wall 14. The outlet portion (and consequently the second rigid conduit 12) terminates in an outlet mouth configured for tightly connecting the second rigid conduit 12 to a second flexible conduit 31 allowing the drying airflow to return into the drum 5.

Figure 13:
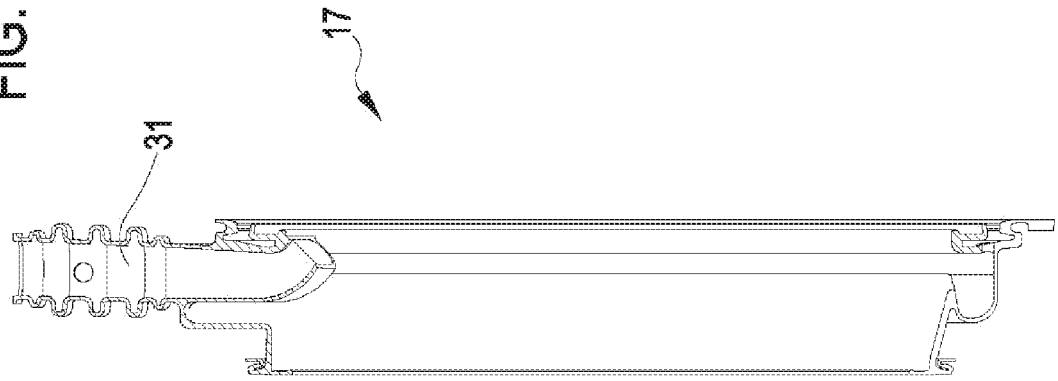
FIG. 12 and FIG. 13 are respectively an axonometric view and a sectional view of a gasket included in the machine according to the disclosure.
Figure 12:
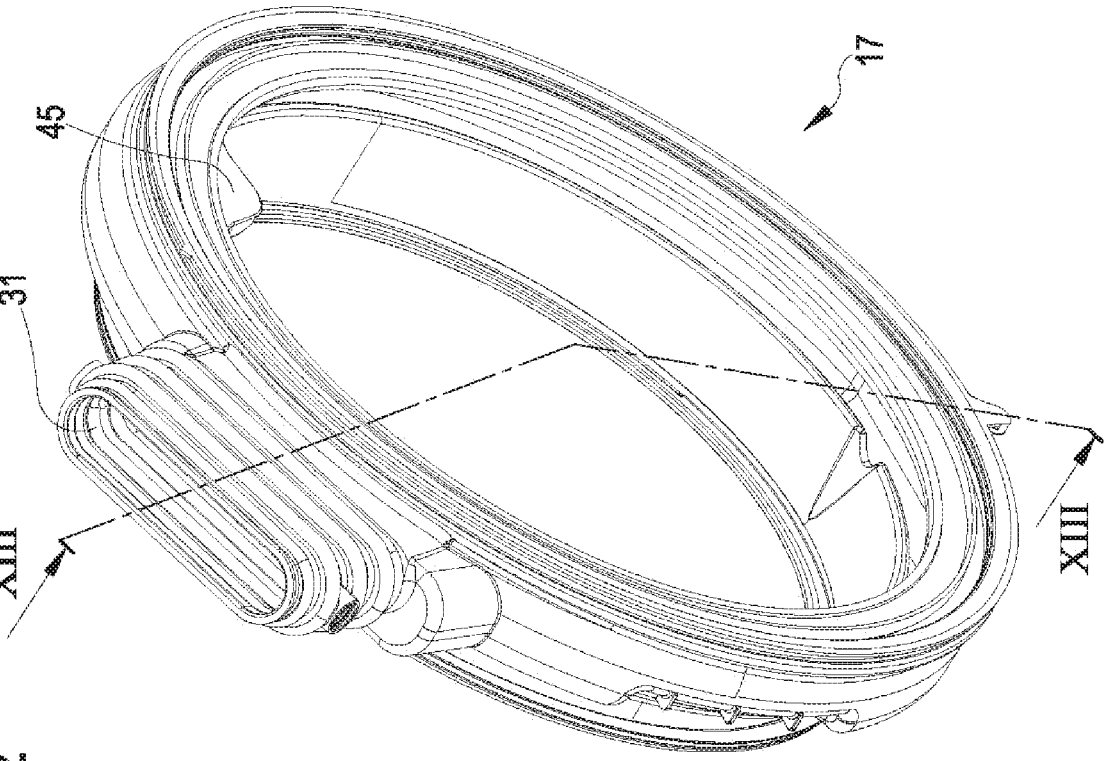

Advantageously the second flexible conduit 31 is built in a single piece with the gasket 17 apt to seal the interspace between the front wall 15 and the door 16. The gasket 17 integrating the second flexible conduit 31 is depicted in FIG. 12 and in FIG. 13. It may be appreciated that the second flexible conduit 31 extends in a radial direction and is positioned in an upper region of the gasket 17, in particular opportunely spaced from a deflector 45 extending inwards from the gasket 17 and apt to help the laundry to be maintained into the drum 5 when the washer-dryer 1 is in operation (an example of such a deflector may be found in the patent EP2513367B1). Such a positioning of the second flexible conduit 31 allows the drying airflow to optimally reach the laundry into the drum 5 for the extraction of the moisture.

Advantageously a flexible coupler is used between the second rigid conduit 12 and the second flexible conduit 31 gasket to reduce the amount of vibrations transmitted to the cabinet 2 by the drying conduit and by the functional components during operation.

Figure 15:
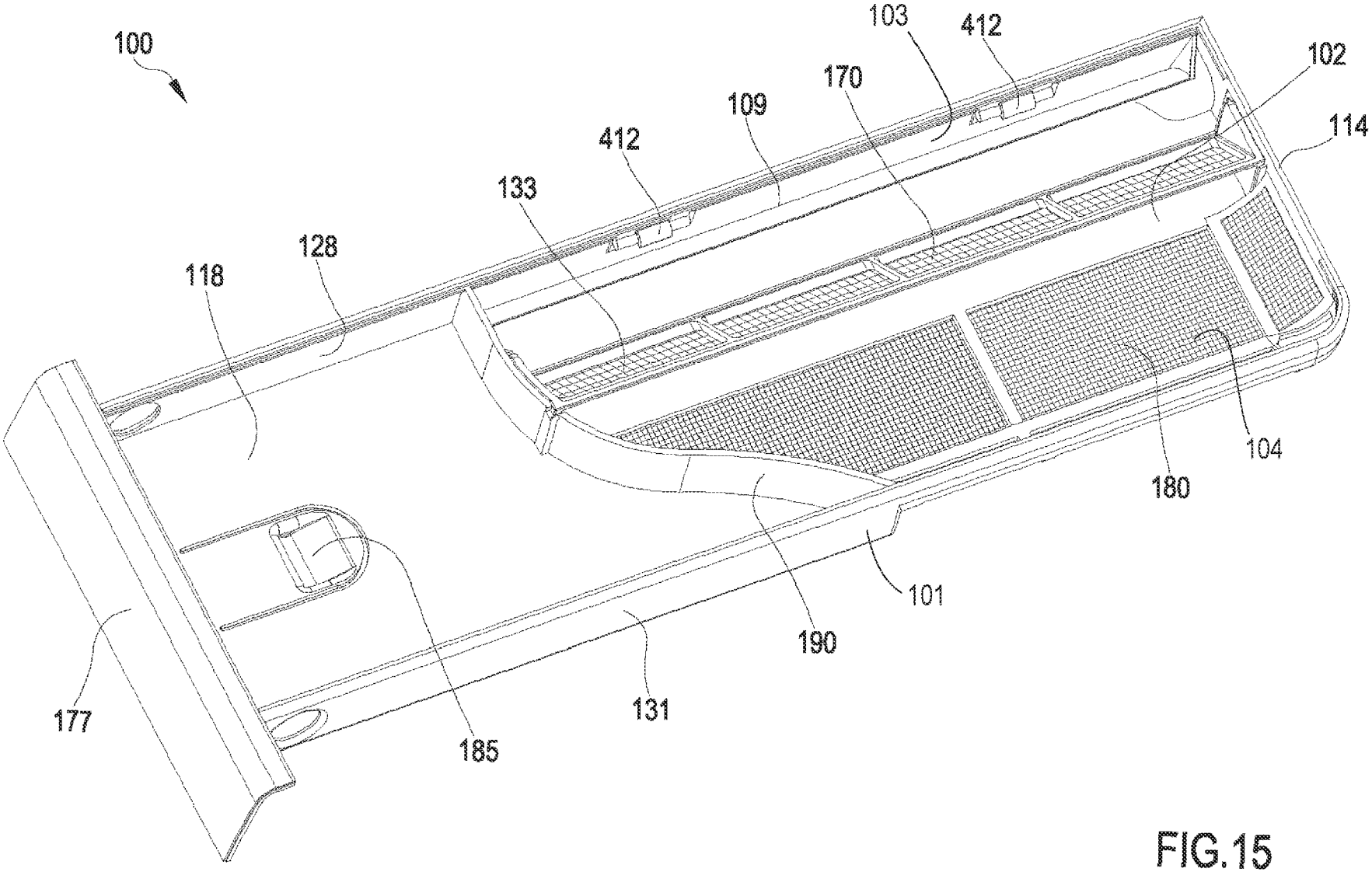
FIG. 15 is a top-down axonometric view of the filter according to the disclosure, wherein the top cover of the filter is removed or made transparent in order to achieve a better visibility of the internal components.
Figure 16:
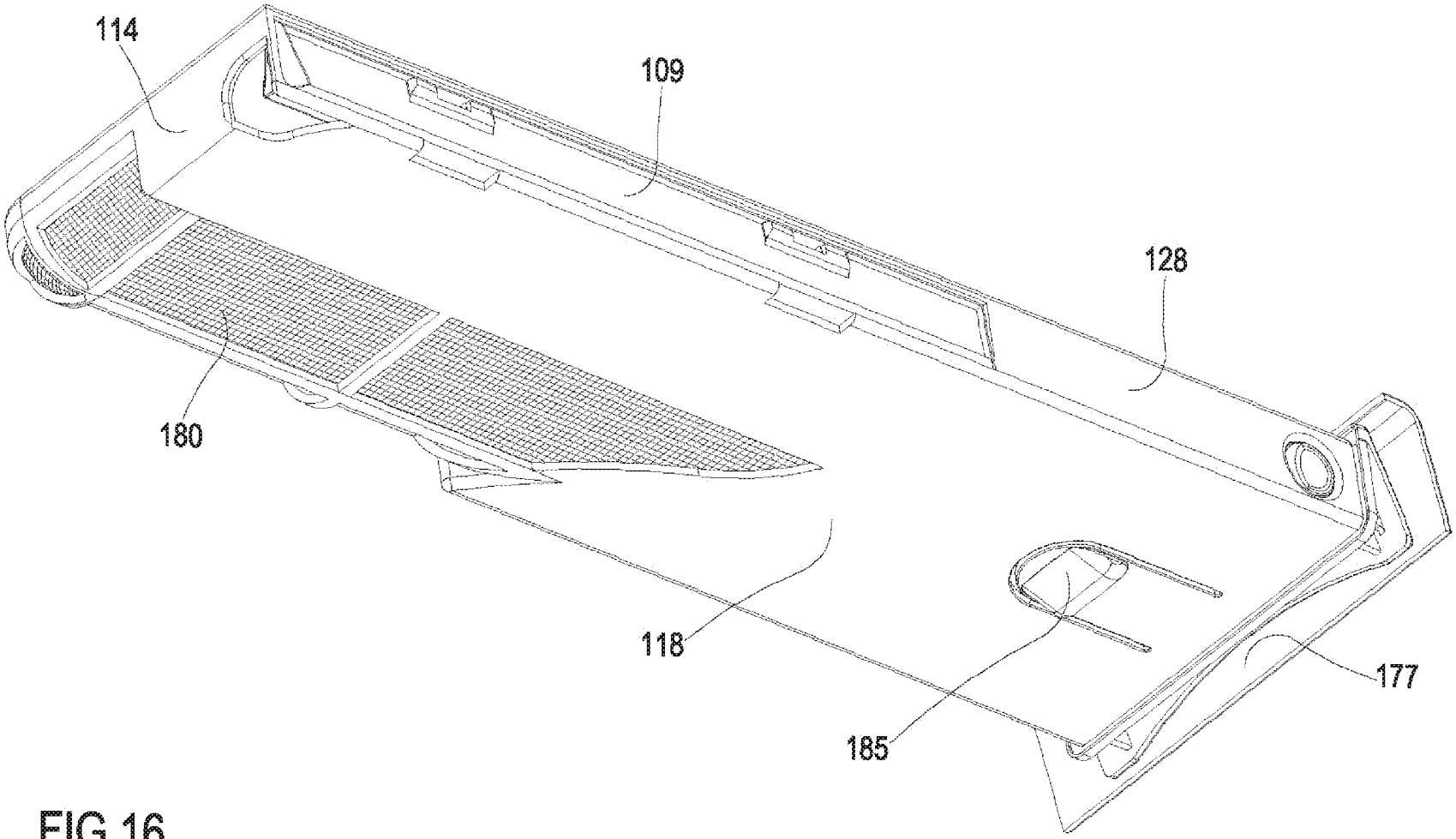
FIG. 16 is a bottom-up axonometric view of the filter according to the disclosure, wherein the top cover of the filter is removed or made transparent in order to achieve a better visibility of the internal components.

FIG. 15 and FIG. 16 depict a filter assembly 100 according to the present disclosure. Even though the filter assembly 100 is conceived to be especially used in combination with the washer-dryer 1, it should be stressed that the filter assembly 100 constitutes a completely autonomous innovation and then it may be profitably used in combination with any machine for drying laundry.

Figure 14:
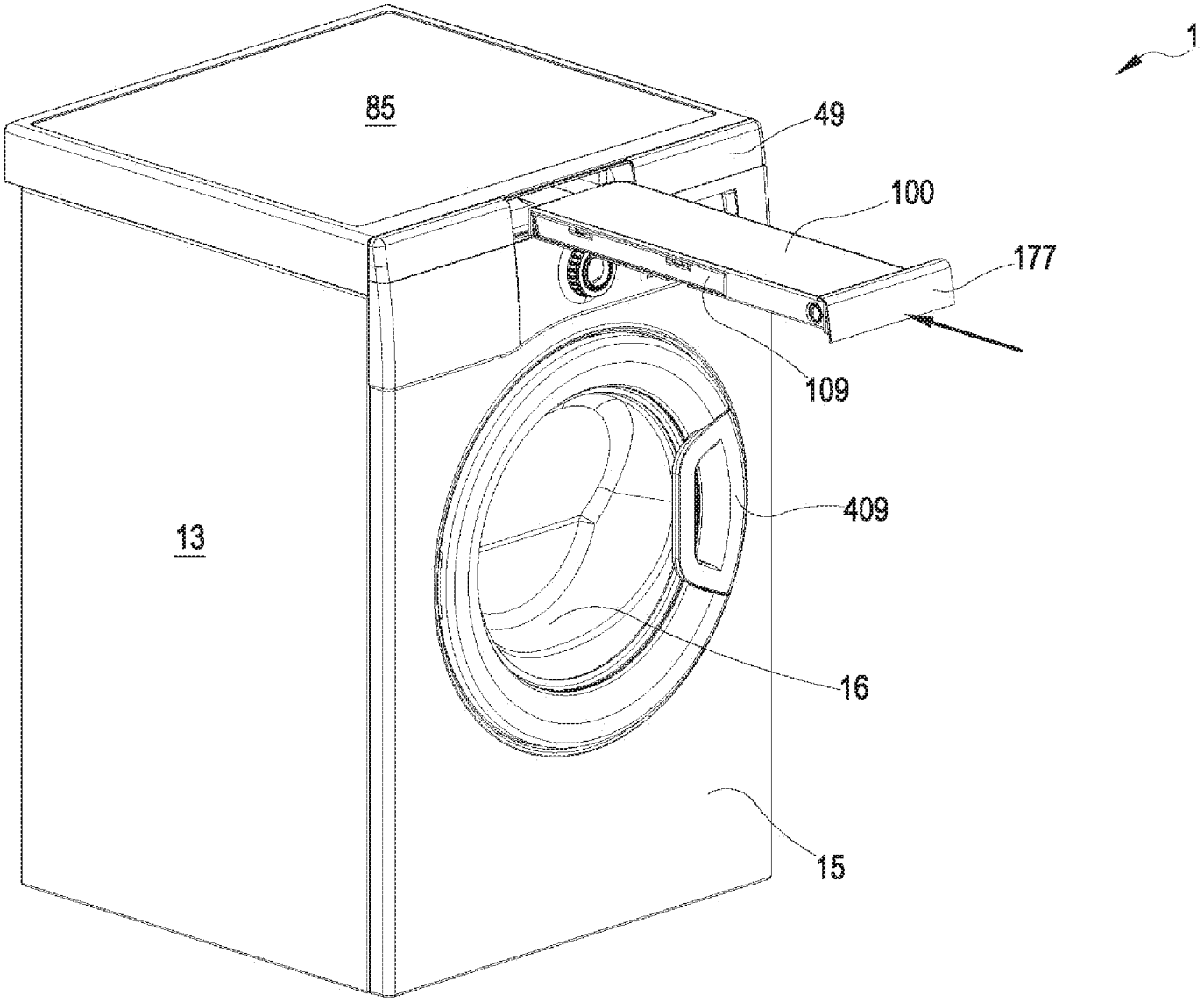
FIG. 14 is an axonometric view representing the insertion of a filter according to the disclosure in a machine according to the disclosure.

The filter assembly 100 is a drawer-like filter and is configured for being housed in a removable manner within a slot of a machine for drying laundry, e.g. within a dedicated slot internal to the cabinet 2 of the washer-dryer 1. Due to the drawer-like configuration, the filter assembly 100 may be comfortably inserted into and removed from the slot, as shown in FIG. 14.

The filter assembly 100 comprises a frame 101. The frame 101 is internally hollow and has a roughly parallelepipedal shape. The frame 101 is preferably made of thermoplastic material and is relatively thin, since the height of the frame 101 is small in comparison with the length and the width of the frame 101. Advantageously the upper surface of the frame 101 is at least partially open and the filter assembly 100 includes a removable cover 123 configured for selectively closing the upper surface of the frame 101.

In the exemplary embodiment shown for instance in FIG. 3, the cover 123 is configured for covering the whole upper surface of the frame 101. In order to support the cover 123 when associated to the frame 101, supporting ribs (visible in FIG. 15) project inwards from the edges of the lateral walls of the frame 101.

Advantageously the filter assembly 100 further includes a handle 177 associated to the front surface of the frame 101. The handle 177 may constitute a separate element rigidly connected to the frame 101 or may be built in a single piece with the frame 101 or with the cover 123. In the exemplary embodiment shown for instance in FIG. 15, the width of the handle 177 exceeds the width of the frame 101, so that a more comfortable grasped of the handle 177 is allowed. As clearly shown in FIG. 1, when the filter assembly 100 is housed into its slot in the washer-dryer 1, the handle 177 is advantageously substantially flush with the front panel 49 of the washer-dryer 1. A push-push mechanism may be envisaged (as an alternative to the handle 177 or in combination with the handle 177) for allowing the filter assembly 100 to be removed from its slot.

Advantageously the filter assembly 100 further includes a stop or stopping means configured for stopping the insertion of the filter assembly 100 in the slot in correspondence when the correct positioning of the filter assembly 100 within the washer-dryer 1 has been reached. The stop comprises in particular an elastic tab 185 associated to a wall of the frame 101, preferably associated to the bottom wall 118 of the frame 101, more preferably made in a single piece with the bottom wall 118 of the frame 101. In the exemplary embodiment depicted in the Figures, the elastic tab 185 cooperates with a conjugated recess 512 positioned in the washer-dryer 1 on the bottom surface of the slot housing the filter assembly 100. When the filter assembly 100 has reached its correct positioning into the slot, the elastic tab 185 enters into the recess 512 and any further insertion movement of the filter assembly 100 is so prevented. At the contrary, due to the elasticity of the elastic tab 185, the opposite movement intended to remove the filter assembly 100 from the slot is allowed.

A duct 102 is defined in the frame 101. The duct 102 is configured for being passed through by an airflow. In the exemplary embodiment shown for instance in FIG. 15, the duct 102 is defined in the rear portion of the frame 101. In particular, the duct 102 is delimited frontally by a deflector 190, at the top by the cover 123 and on the remaining sides by the walls of the frame 101. Advantageously the deflector 190 is not parallel to the rear wall 114 of the frame 101 in order to allow the duct 102 to act as a convergent or divergent duct for the airflow passing through it. The deflector 190 is preferably curved in order to convey opportunely the airflow and simultaneously to stem the consequent load losses. The deflector 190 projects from the bottom wall 118 of the frame 101 and is opportunely made in a single piece with the frame 101.

An inlet section 103 is obtained in at least one wall of the frame 101 and is configured for allowing the airflow to have access to the duct 102. Additionally an outlet section 104 (opportunely spaced from the inlet section 103) is obtained in at least one wall of the frame 101 and is configured for allowing the airflow to leave the duct 102. In the exemplary embodiment shown in the Figures, the inlet section 103 is obtained in a first lateral wall 128 of the frame 101, whilst the outlet section 104 is obtained partly in a second lateral wall 131 of the frame 101 (opposite to the a first lateral wall 128) and partly in the bottom wall 118. Since the extension of the inlet section 103 is bigger than the extension of the portion of the outlet section 131 obtained in the second lateral wall 131, it follows that the duct 102 defined by the deflector 190 acts as a convergent duct.

The filter assembly 100 further comprises a filter or filtering means configured for intercepting the airflow and for separating from the airflow possible solid particles, in particular fluff, carried by the airflow. The action of the filter on the airflow is performed between the inlet section 103 and the outlet section 104. In the exemplary embodiment shown in the Figures, the filter includes a first filtering mesh 170 and a second filtering mesh 180, the first filtering mesh 170 being positioned upstream of the second filtering mesh 180 and being coarser than the second filtering mesh 180. The first filtering mesh 170 and the second filtering mesh 180 comprise respective metal wires meshes, the metal wires are more dense in the second filtering mesh 180 than in the first filtering mesh 170.

The first filtering mesh 170 can be supported by a supporting structure 133 associated to the frame 101 preferably in a removable manner and substantially aligned with the first lateral wall 128 and with the second lateral wall 131. In order to allow the mounting of a more extended first filtering mesh 170, the supporting structure 133 is considerably inclined with respect to the first lateral wall 128 and to the second lateral wall 131. The supporting structure 133 is adjacent to the deflector 190 and to the bottom wall 118 as well, so that the whole airflow is subjected to a first rough filtering when it passes through the duct 102. The second filtering mesh 180 can be associated instead to the outlet section 104. In particular, the second filtering mesh 180 occupies the whole outlet section 104, so that the whole airflow is subjected to a second fine filtering when it passes through the outlet section 104.

The filter assembly 100 further comprises storage or storage means configured for storing the solid particles separated from the airflow. In particular, the storage comprises a first storage room and a second storage room positioned upstream of the first filtering mesh 170 and of the second filtering mesh 180 respectively. When the filter 101 is removed from the washer-dryer 1, the first storage room and the second storage room can be easily accessed by the user for cleaning and/or removal of collected fluff operations simply by detaching the cover 123 from the frame 101.

Figure 2:
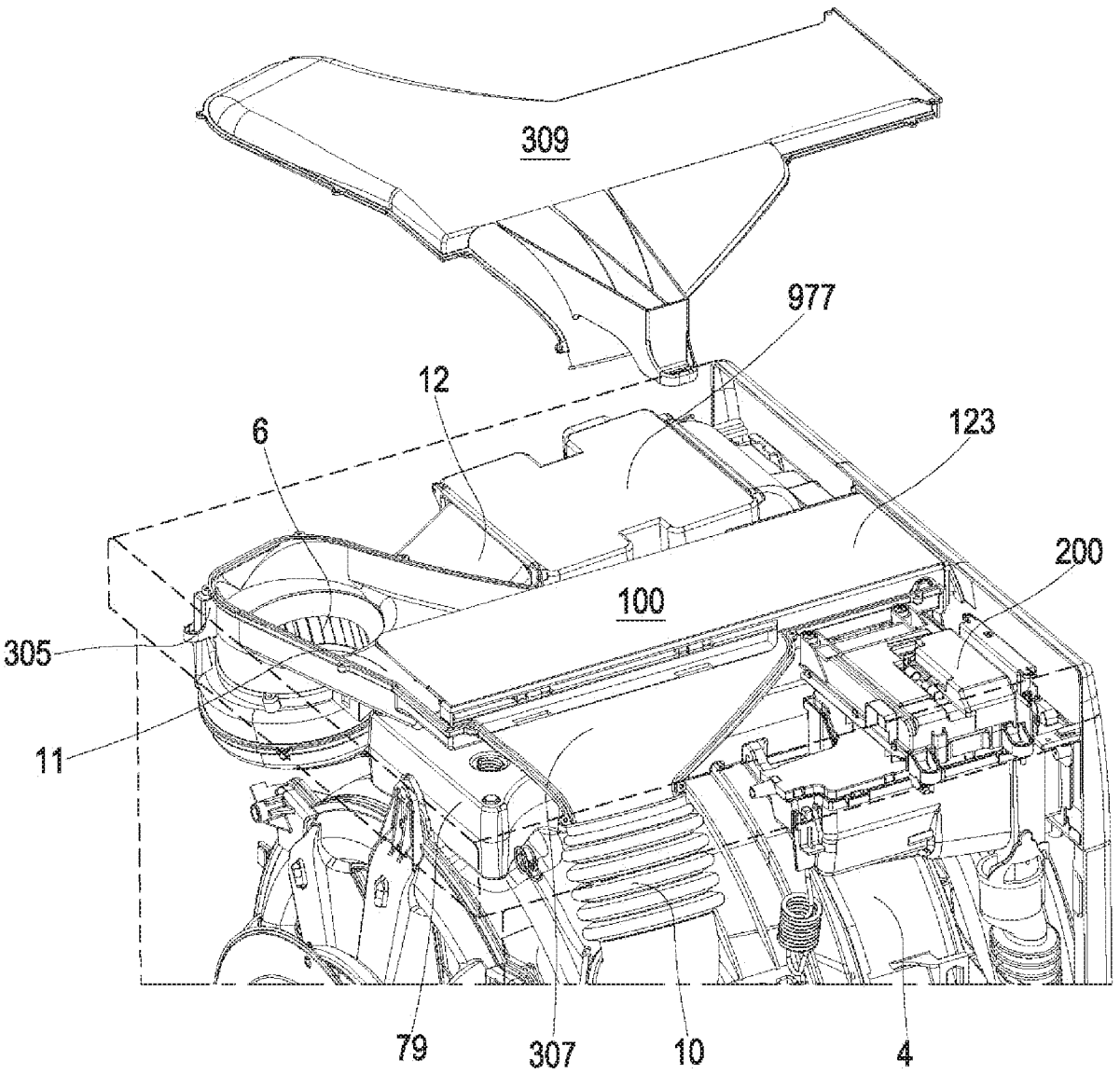
FIG. 2 and FIG. 3 are partially exploded views of the machine according to the disclosure, wherein same components of the machine are removed or made transparent in order to achieve a better visibility of the internal components.

Therefore the filter assembly 100 may assume, with respect to the washer-dryer 1, at least a first position and a second position. In the first position, the filter assembly 100 is extracted from the slot completely (as shown in FIG. 14) or at least partly so that the storage is accessible for cleaning and/or removal of collected fluff operations, whilst in the second position the filter assembly 100 is housed in the slot (as shown in FIG. 1 and in FIG. 2) so that the filter can intercept the airflow and can separate from the airflow the fluff carried by the airflow. The second position constitutes hence the working position of the filter assembly 100. In the exemplary embodiment shown in the Figures, the changes from the first position to the second position and to the second position to the first position require both a translational movement of the filter assembly 100 with respect to the washer-dryer 1.

The slot within the cabinet 2 of the washer-dryer 1 communicates with the drying circuit (in particular with a rigid conduit such as the first rigid conduit 11) and is preferably positioned substantially above the drum 5. Indeed, as previously described, the slot in the cabinet 2 includes a housing for the filter assembly 100 defined in an intermediate portion of the first rigid conduit 11. The duct 102 is configured for acting as a stretch of the drying circuit when the filter assembly 100 is in the second position and is hence housed in the first rigid conduit 11. For this purpose, the deflector 190 is configured for acting as a wall of a first rigid conduit 11 and is positioned contiguous to the adjacent walls of the first rigid conduit 11 when the filter assembly 100 assumes the second position, in order to reinstate the continuity of the lateral wall of the first rigid conduit 11 and hence to avoid that a fraction of the airflow may escape from the drying circuit at the interface between the first rigid conduit 11 and the filter assembly 100.

A closure or closing means are associated to the inlet section 103. Preferably, the closure comprises a rotatable flap 109 hinged to the frame 101. Advantageously, the rotatable flap is made of thermoplastic material. In the exemplary embodiment shown in the Figures, the inlet section 103 and the rotatable flap 109 have both a roughly rectangular shape. The upper edge of the inlet section 103 is coupled to the upper edge of the rotatable flap 109 via a revolute joint allowing only a (limited) rotation of the rotatable flap 109 around an axis parallel to the upper edge of the rotatable flap 109. For instance, this revolute joint may be obtained with a couple of hinges 412 disposed at the upper edge of the inlet section 103 (of course the number of hinges associated to the rotatable flap may be different than two). The positioning of the hinges 412 is particularly beneficial since the rotatable flap 109 is allowed because of this positioning to close by gravity the inlet section 103 if no further constraints act on the rotatable flap 109. Contrast springs may be associated to the hinges 412 to counter unintentional openings of the flap 109 when the filter assembly 100 is extracted from the washer-dryer 1. As an alternative to the rotatable closure depicted in the Figures, a flap slidable with respect to the frame 101 may be used in the filter assembly 100.

According to the disclosure, the closure is selectively switchable between a first configuration and a second configuration. In the first configuration of the closure (shown for instance in FIG. 22), the inlet section 103 is closed so that the access of the airflow to the duct 102 is substantially prevented, whilst in the second configuration of the closure (shown for instance in FIG. 18), the inlet section 103 is open so that the access of the airflow to the duct 102 is allowed.

Advantageously, an actuator or actuating means are associated to the closure. The actuator is configured for switching automatically the configuration of the closure from the first configuration to the second configuration and/or from the second configuration to the first configuration. Advantageously the actuator includes the rotatable flap 109 or at least a portion of the rotatable flap 109, in particular the end portion 108 of the rotatable flap 109 nearest to the rear wall 114 of the frame 101. In particular, the end portion 108 has a peculiar shape allowing it to act as a member of the actuator of the filter assembly 100. In particular, while the most of the rotatable flap 109 has a planar extension, the end portion 108 has a curved extension and exhibits a rounded profile allowing the end portion 108 to act as a member of a cam coupling. Advantageously, the end portion 108 develops from the planar portion of the rotatable flap 109 without solution of continuity.

Figure 23:
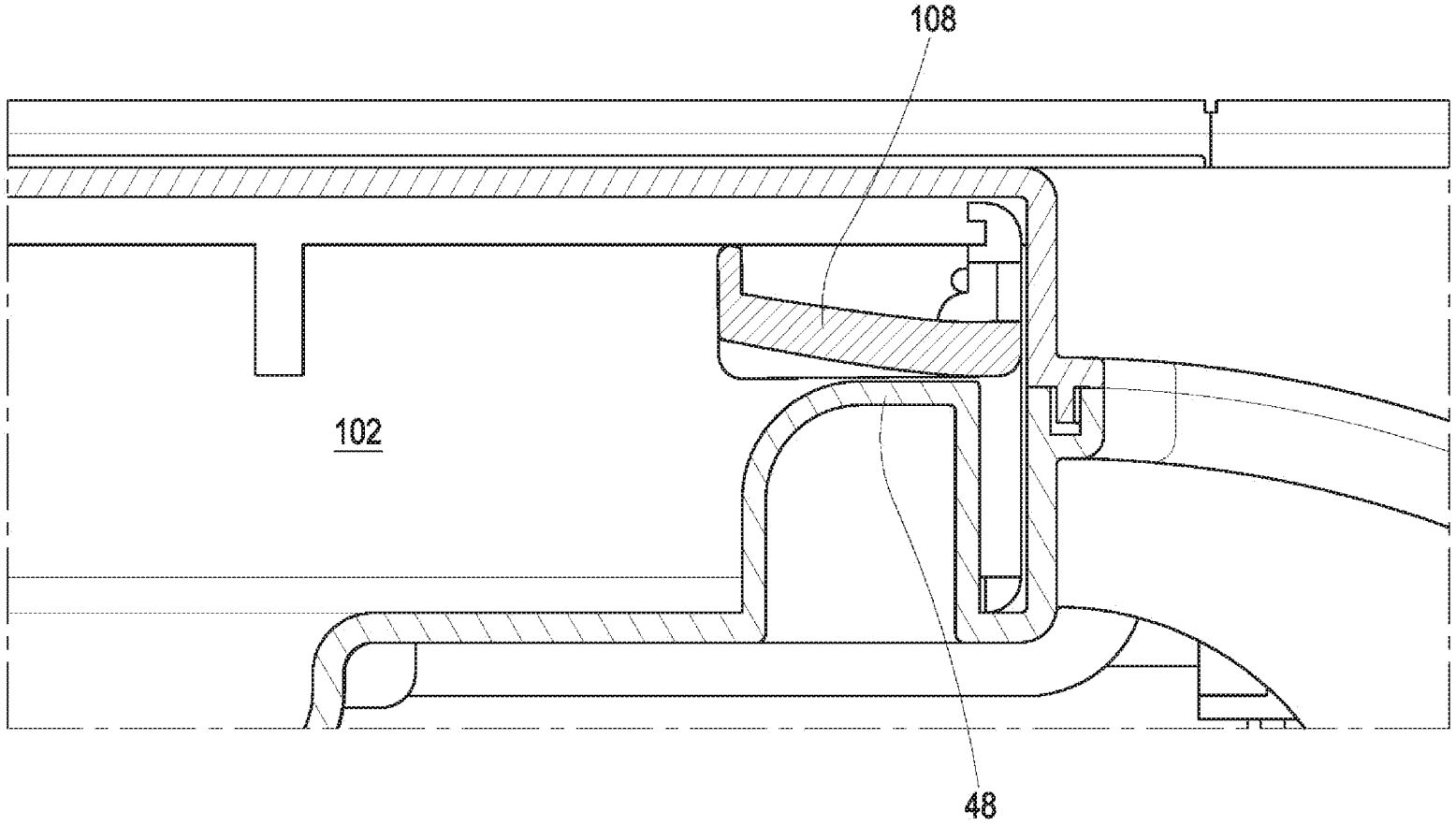
FIG. 23 is an axonometric view representing the coupling between the closureclosure of a filter according to the disclosure and the actuator of a machine according to the disclosure when the closureclosure is in the second configuration.

The actuator associated to the filter assembly 100 is configured for cooperating with the correspondent actuator associated to the washer-dryer 1. According to the exemplary embodiment shown in the Figures, the actuator of the washer-dryer 1 comprises a bulge 48 configured for interacting with the actuator of the filter assembly 100, in particular with the end portion 108 of the rotatable flap 109. The bulge 48 indeed exhibits a rounded profile conjugated to the rounded profile of the end portion 108 of the rotatable flap 109, in order to act as a member of a cam coupling. Kinematically, the end portion 108 and the bulge 48 constitute a higher pair, because their mutual constraint requires that the surface of the movable body, i.e. of the end portion 108, maintains the contact with the surface of the fixed body, i.e. of the bulge 48. The representation in FIG. 23 shows in detail the contact between the surface of the end portion 108 and the surface of the bulge 48 at the end of the relative movement between the end portion 108 and the bulge 48, i.e. when the second position of the filter assembly 100 is reached.

If the slot in the cabinet 2 includes a housing for the filter assembly 100 defined in a conduit of the drying circuit, the bulge 48 may advantageously be built in a single piece with a component of that conduit. If in particular the slot in the cabinet 2 includes a housing for the filter assembly 100 defined in an intermediate portion of the first rigid conduit 11, the bulge 48 may advantageously protrude from the top surface of the lower element 307 of the first rigid conduit 11 and may be built in a single piece with a component of that conduit The actuator of the filter assembly 100 and of the washer-dryer 1 are configured for switching in combination the configuration of the closure from the first configuration to the second configuration when the position of the filter assembly 100 changes from the first position to the second position and/or from the second configuration to the first configuration when the position of the filter assembly 100 changes from the second position to the first position. In the exemplary embodiment shown in the Figures, the end portion 108 of the rotatable flap 109 is configured for actuating, in combination with the bulge 48, the switching of the configuration of the closure from the first configuration to the second configuration. The switching of the configuration of the closure from the second configuration to the first configuration instead takes place under the action of the gravitational force and/or of an elastic force.

The operation of the filter assembly 100 according to the present disclosure is fully clear in view of the description above in combination with the referred Figures. Until the filter assembly 100 is in the second position (i.e. when the filter assembly 100 is housed in the dedicated slot), the actuator keeps the closure in the second configuration and then the inlet section 103 of the filter assembly 100 is open. Because the duct 102 in the frame 101 of the filter assembly 100 is integral to the drying circuit of the washer-dryer 1 when the filter assembly 100 is in the second position, the filter intercepts the drying airflow circulating in the drying circuit and separate from the airflow the possible fluff carried by the drying airflow. The fluff separated from the drying airflow accumulates inside the storage. When the drying of the laundry in the drum 5 is completed, the user manually (in particular by pulling the handle 177) extracts the filter assembly 100 from the slot for performing the removal of the fluff collected in the storage of the filter assembly 100. The switching of the position of the filter from the second position to the first position automatically provokes the switching of the configuration of the closure from the second configuration to the first configuration. In particular, during the extraction of the filter assembly 100, the inlet section 103 is automatically closed by the rotatable flap 109 moving by gravity. Therefore collected fluff is prevented from escaping from the filter assembly 100 via the inlet section 103 during the extraction of the filter assembly 100. The process for removing collected fluff is then completed by the user by separating the cover 123 from the frame 101 and by properly cleaning the filter assembly 100 (e.g. with the aid of a brush).

After the cleaning of the filter assembly 100 with the removal of the collected fluff and after the repositioning of the cover 123, the user inserts the filter assembly 100 into the slot in the washer-dryer 1 in order to bring the filter assembly 100 in the second position again. The switching of the closure from the first configuration to the second configuration operated by the actuator is represented in the sequence from FIG. 17 to FIG. 22.

In FIG. 17 and in FIG. 18, the end portion 108 of the rotatable flap 109 is approaching the bulge 48 disposed at the end of the slot in the washer-dryer 1. There is still no contact between the surface of the end portion 108 and the surface of the bulge 48, so that the inlet section 103 is kept closed by the rotatable flap 109 and no airflow can have access to the duct 102.

In FIG. 19 and in FIG. 20, the surface of the end portion 108 has come into contact with the surface of the bulge 48. The contact between the surface of the end portion 108 and the surface of the bulge 48 raises the rotatable flap 109 that consequently rotates away from the inlet section 103. The opening degree of the inlet section 103 then increases progressively.

Figure 21:
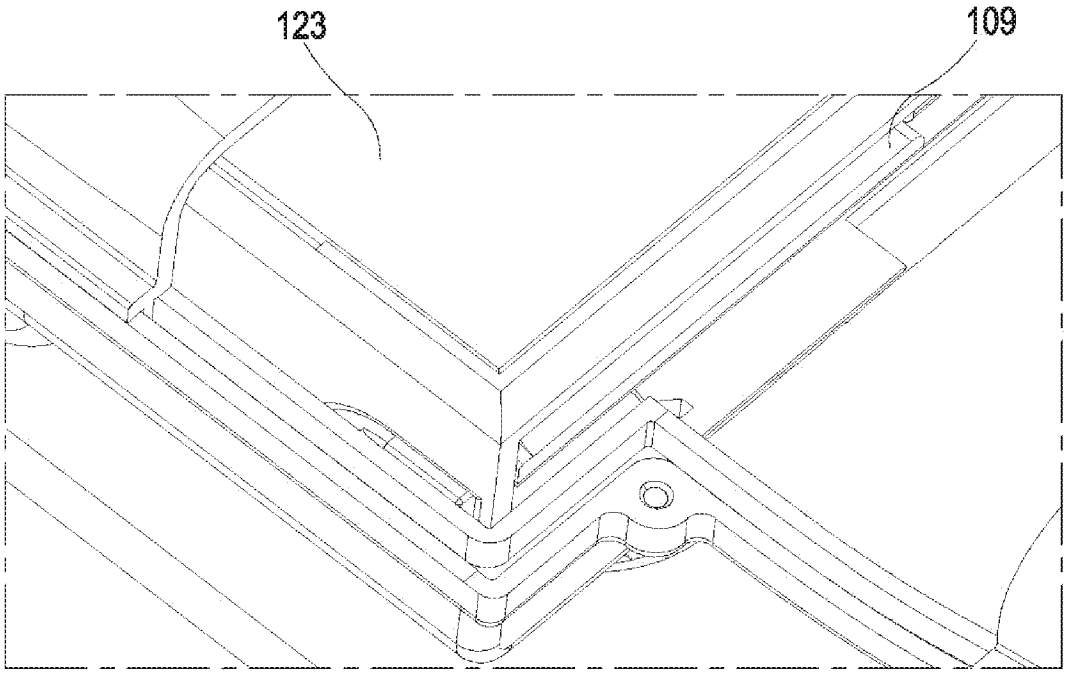
Figure 22:
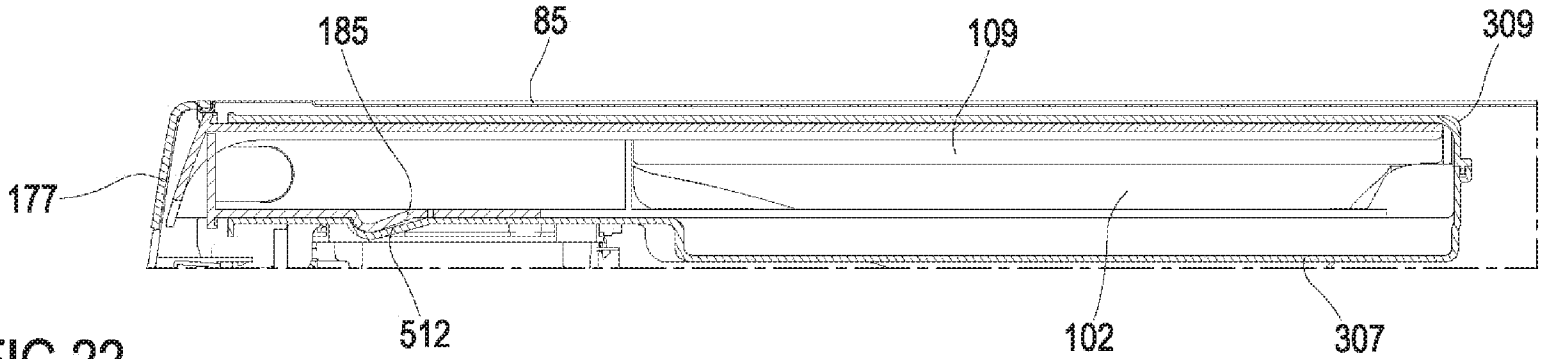

In FIG. 21 and in FIG. 22, the filter assembly 100 has reached the second position. The stop prevents any further insertion of the filter assembly 100 into the slot in the washer-dryer 1. In particular, the elastic tab 185 has completely entered into the recess 512 and the handle 177 is substantially flush with the front panel 49 of the washer-dryer 1 (as can be appreciated in the representation in FIG. 22). The rotatable flap 109 has terminated its rotation away from the inlet section 103 and the surface of the end portion 108 maintains its contact with the surface of the bulge 48 in order to maintain the closure in the second configuration, wherein the inlet section 103 is open and the drying airflow circulating in the drying circuit of the washer-dryer 1 is allowed to have access to the duct 102 for being intercepted by the filter.

It's absolutely apparent from the description above that significant advantages are achieved by means of the present disclosure. Indeed the present disclosure makes possible the realization of a filter to be installed in a drying circuit of a machine for drying laundry which ensures the highest reliability and which allows the drying circuit to function properly, safely and effectively. The ergonomics of the machine for drying laundry is enhanced by the filter according to the present disclosure and the operations requested to the user are really comfortable. The filter according to the present disclosure is moreover particularly adapted to be installed in a washer-dryer equipped with a heat pump system.

The present disclosure is to realizes a benefit of a filter in a drying circuit of a machine for drying laundry (for the separation of the fluff from the drying airflow that carries the fluff) which ensures the highest reliability and which allows the drying circuit to function properly, safely and effectively. Another benefit of the present disclosure is to realize a filter to be installed in a drying circuit of a machine for drying laundry that contributes to enhance the ergonomics of the machine and to make more comfortable the operations requested to the user. Yet another benefit of the present disclosure is to realize a filter to be installed in a drying circuit of a machine for drying laundry that is particularly adapted to be installed in a washer-dryer, especially in a washer-dryer equipped with a heat pump system.

The invention claimed is:

1. A filter assembly configured to be removably inserted in combination with a machine for drying laundry comprising:

a frame;

a duct defined in the frame and configured for being passed through by a drying airflow;

an inlet section configured for allowing the airflow to have access to the duct;

an outlet section configured for allowing the airflow to leave the duct;

a filter configured for intercepting the airflow and for separating from the airflow particles carried by the airflow, the filter acting between the inlet section and the outlet section; and a closure associated with the inlet section comprising a rotatable flap hinged to the frame and moveable between a first configuration where the rotatable flap is held in an open position when the filter is inserted in the machine for drying laundry and a second configuration where the rotatable flap moves to a closed position when the filter is removed from the machine for drying laundry; the rotatable flap comprising an end portion having a rounded profile and configured to cooperate with a bulge positioned on the machine for drying laundry; the bulge comprising a rounded profile conjugated to the rounded profile of the end portion of the rotatable flap profile in order to act as a member of a cam coupling between the bulge and the end portion;

wherein in the first configuration, upon insertion of the filter into the duct, the rounded profile of the bulge contacts the end portion of the rotatable flap and causes the rotatable flap to rotate towards the open position and holds the rotatable flap in an open position when fully inserted so that the access of the airflow to the duct is allowed, and in the second configuration, upon withdrawing the filter from the duct, the rounded profile of the bulge causes the rotatable flap to rotate toward the closed position and upon removal of the filter, the bulge does not contact the end portion and the rotatable flap moves to the closed position so that the access of the airflow to the duct is substantially prevented.

2. The filter assembly configured to be removably inserted in combination with a machine for drying laundry according to claim 1, wherein the closure is rotatable with respect to the frame.

3. The filter assembly configured to be removably inserted in combination with a machine for drying laundry according to claim 1, wherein the end portion of the rotatable flap comprises a rounded profile.

4. The filter assembly configured to be removably inserted in combination with a machine for drying laundry according to claim 3, wherein movement of the rotatable flap from the open position to the closed position takes place under the action of a gravitational force or elastic force.

5. The filter assembly configured to be removably inserted in combination with a machine for drying laundry according to claim 1, wherein the filter comprises a first filtering mesh and a second filtering mesh, the first filtering mesh being positioned upstream of the second filtering mesh and being coarser than the second filtering mesh.

6. The filter assembly configured to be removably inserted in combination with a machine for drying laundry according to claim 5, wherein the second filtering mesh is associated to the outlet section, the outlet section being in particular defined in a lateral wall of the frame and/or in a bottom wall of the frame.

7. The filter assembly configured to be removably inserted in combination with a machine for drying laundry according to claim 1, wherein the frame comprises a deflector configured for making said duct convergent.

8. The filter assembly configured to be removably inserted in combination with a machine for drying laundry according to claim 1, wherein the filter assembly is a drawer configured to be housed in a slot of a machine for drying laundry.

9. The filter assembly configured to be removably inserted in combination with a machine for drying laundry according to claim 8, further comprising a stop configured for stopping the insertion of the filter assembly in the slot.

10. The filter assembly configured to be removably inserted in combination with a machine for drying laundry according to claim 9, wherein the stop comprises an elastic tab positioned on a bottom wall of the frame.

* * * * *